US007932863B2

(12) United States Patent
Pros et al.

(10) Patent No.: US 7,932,863 B2
(45) Date of Patent: Apr. 26, 2011

(54) SHAPED GROUND PLANE FOR RADIO APPARATUS

(75) Inventors: Jaume Anguera Pros, Castellon (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 687 days.

(21) Appl. No.: 11/793,406

(22) PCT Filed: Dec. 29, 2005

(86) PCT No.: PCT/EP2005/057215
§ 371 (c)(1),
(2), (4) Date: Jul. 19, 2007

(87) PCT Pub. No.: WO2006/070017
PCT Pub. Date: Jul. 6, 2006

(65) Prior Publication Data

US 2008/0231521 A1 Sep. 25, 2008

Related U.S. Application Data

(60) Provisional application No. 60/640,645, filed on Dec. 30, 2004.

(51) Int. Cl.
*H01Q 1/24* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS 4,141,014 A 2/1979 Sletten
(Continued)

FOREIGN PATENT DOCUMENTS

CA 2416437 A1 1/2002
(Continued)

OTHER PUBLICATIONS

Karaboikis, M. et al, "Compact dual-printed inverted-F antenna diversity systems for portable wireless devices", IEEE Antennas and wireless propagation letters, vol. 3, 2004.

(Continued)

*Primary Examiner* — Douglas W Owens
*Assistant Examiner* — Dieu Hien T Duong
(74) *Attorney, Agent, or Firm* — Winstead PC

(57) ABSTRACT

This invention refers to an antenna structure for a wireless device comprising a ground plane and an antenna element, wherein the ground plane has a slot with at least a short end, an open end and a length substantially close to a quarter wavelength. The feeding and ground connections of the antenna structure are placed at the two different sides of said slot and the distance of at least one of them to the short end of the slot is equal or smaller than an eighth of the wavelength. The invention further refers to an antenna structure for a wireless device comprising a ground plane and an antenna element, wherein the ground plane has a slot with at least two short ends, and a length substantially close to half wavelength. The feeding and ground connections of the antenna structure are placed at the two different sides of said slot and the distance of at least one of them to a short end of the slot is equal or smaller than a quarter of the wavelength. Further the invention refers to a corresponding wireless device, a corresponding mobile phone and to a method for integrating such an antenna structure within a wireless device.

41 Claims, 14 Drawing Sheets

U.S. PATENT DOCUMENTS

| | | | | |
|---|---|---|---|---|
| 5,268,696 | A | 12/1993 | Buck et al. | |
| 5,608,413 | A | 3/1997 | Macdonald | |
| 5,777,581 | A | 7/1998 | Lilly et al. | |
| 5,903,822 | A | 5/1999 | Sekine et al. | |
| 6,002,367 | A | 12/1999 | Engblom | |
| 6,239,762 | B1 | 5/2001 | Lier | |
| 6,307,519 | B1 | 10/2001 | Livingston et al. | |
| 6,314,273 | B1 | 11/2001 | Matsuda | |
| 6,377,217 | B1 | 4/2002 | Zhu | |
| 6,388,620 | B1 | 5/2002 | Bhattacharyya | |
| 6,388,631 | B1 | 5/2002 | Livingston et al. | |
| 6,462,710 | B1 | 10/2002 | Carson | |
| 6,466,176 | B1 | 10/2002 | Maoz | |
| 6,538,603 | B1 | 3/2003 | Chen | |
| 6,717,551 | B1 | 4/2004 | Desclos et al. | |
| 6,756,939 | B2 | 6/2004 | Chen | |
| 6,911,939 | B2 | 6/2005 | Carson et al. | |
| 6,985,108 | B2 | 1/2006 | Mikkola et al. | |
| 7,586,414 | B2 | 9/2009 | Kai et al. | |
| 2003/0071763 | A1 | 4/2003 | McKinzie | |
| 2003/0122721 | A1* | 7/2003 | Sievenpiper | 343/767 |
| 2003/0193437 | A1 | 10/2003 | Kangasvieri | |
| 2004/0017318 | A1 | 1/2004 | Annabi et al. | |
| 2004/0058723 | A1 | 3/2004 | Mikkola | |
| 2004/0217916 | A1 | 11/2004 | Quintero Illera | |
| 2005/0110690 | A1 | 5/2005 | Ko et al. | |
| 2005/0237251 | A1 | 10/2005 | Boyle et al. | |
| 2007/0040751 | A1 | 2/2007 | Boyle | |
| 2008/0074332 | A1 | 3/2008 | Arronte et al. | |

FOREIGN PATENT DOCUMENTS

| | | | |
|---|---|---|---|
| EP | 0505540 | A1 | 9/1992 |
| EP | 0 548 975 | | 6/1997 |
| EP | 0 892 459 | | 1/1999 |
| EP | 1 401 050 | | 3/2004 |
| EP | 1401050 | A1 | 3/2004 |
| EP | 1837950 | A2 | 9/2007 |
| GB | 2391114 | A | 1/2004 |
| JP | 200512516 | A | 1/2005 |
| WO | 9627219 | A1 | 9/1996 |
| WO | 00/30211 | | 5/2000 |
| WO | WO-01/22528 | | 3/2001 |
| WO | WO-01/54225 | | 7/2001 |
| WO | WO-0189031 | A1 | 11/2001 |
| WO | 0229929 | A2 | 4/2002 |
| WO | WO-0235652 | A1 | 5/2002 |
| WO | 03023900 | A1 | 3/2003 |
| WO | WO-03/023900 | | 3/2003 |
| WO | WO-03/034544 | A1 | 4/2003 |
| WO | 03096475 | A1 | 11/2003 |
| WO | 2004001894 | A1 | 12/2003 |
| WO | WO 2004/001894 | | 12/2003 |
| WO | 2004133933 | A1 | 2/2004 |
| WO | WO-2004/102744 | A1 | 11/2004 |
| WO | 2006031170 | A1 | 3/2006 |
| WO | 2006032455 | A1 | 3/2006 |
| WO | 2006070017 | A1 | 7/2006 |
| WO | WO-2006/120250 | A2 | 11/2006 |

OTHER PUBLICATIONS

Moretti, P. et al, "Numerical investigation of vertical contactless transitions for multilayer RF circuits", IEEE MTT-S International Microwave Symposium Digest, 2001.

Chu, J.L., Physical limitations of omni-directional atnennas, Journal of Applied Physics, 1948, vol. 19.

Hansen, R. C., "Fundamental Limitations in Antennas", Proceedings of the IEEE, vol. 69, No. 2, Feb. 1981, pp. 170-182 (abstract only).

Chiou, Tzung-Wern et al., "Designs of Compact Microstrip Antennas with Slotted Ground Plane", Antennas and Propagation Society International Symposium, IEEE, vol. 2, 2001, pp. 732-735 (abstract only).

Manteuffel, Kirk et al., "Investigation on Integrated Antennas for GSM Mobile Phones", Millennium Conference on Antennas and Propagation, ESA, Switzerland, Apr. 2000, 4 pages.

X.H. Yang. Multifrequency operation technique for aperture coupled microstrip antennas, Antennas and propagation society international symposium, 1994.

T.W. Chiou, Designs of compact microstrip antennas with a slotted ground plane, Antennas and propagation society international symposium, 2001.

C.H. Huang, Dielectric resonator antenna on a slotted ground plane, Electronic Letters, 2003.

C.H. Huang, Slotted ground plane for frequency tunable dielectric resonator antenna, Microwave and Optical Technology Letters, 2002, vol. 35.

T. Kim, et al. Design of a wideband microstrip array antenna for PCs and INT-2000 service, Microwave and Optical Technology Letters, 2001, vol. 30.

K.L. Wong, Compact and broadband microstrip antennas, A Wiley Interscience, 2003.

Z. Du, A compact planar inverted-F antenna with a PBG-type ground plane for mobile communications, IEEE Transactions on Vehicular Technology, 2003, vol. 52.

R. Hossa, Improvement of compact terminal antenna performance by incorporating open-end slots in ground plane, IEEE Microwave and Wireless Components Letters, 2004, vol. 14.

S.Y. Ke. Broadband proximity-coupled microstrip antennas with an H-shaped slot in the ground plane, IEEE Antennas and Propagation, 2002.

Ferrero et al. Dual-band circularly polarized microstrip antenna for satellite applications, IEEE Antennas and Wireless Propagation Letters, 2005, vol. 4.

Kyriacou et al. Design procedure for aperture coupled microstrip antennas based on approximate equivalent networks, Microwave and Optical Technology, 2002.

Cabedo, Antenas multibanda para aplicaciones 2G, 3G, WIFI, WLAN y Bluetooth en terminales móviles de nueva generación,Thesis on Fractus & La Salle, 2001.

Wong, Planar antennas for wireless communications, Wiley Interscience, 2003.

Kivekas, Design of high-efficiency antennas for mobile communications devices, Helsinki University, 2005.

Ollikainen, Design and implementation techniques of wideband mobile communications antennas, Helsinki University, 2004.

Ojefors, Micromachined antennas for integration with silicon based active devices, Uppsala University, Sweden, 2004.

Sanad, A very small double C-patch antenna contained in a PCMCIA standard PC card, Ninth International Conference on Antennas and Propagation, 1995.

Maci et al. Dual frequency patch antennas, IEEE Antennas and Propagation Magazine, 1997, vol. 39.

Huang, Cross slot-coupled microstrip antenna and dielectric resonator antenna for circular polarization, IEEE Tranactions on Antennas and Propagation, 1999, vol. 47.

M.F. Abedin et al. Modifying the ground plane and its effect on planar inverted-F antennas (PIFAs) for mobile phone handsets, IEEE Antennas and Wireless Propagation Letters 2003, vol. 2.

Yang, F. Patch antenna with switchable slots (PASS): REconfigurable design for wireless communications, IEEE Antennas and Propagation Society International Symposium, 2002.

Zhao, A.P., Quarter-wavelength wideband slot antenna for 3-5 GHz mobile applications, IEEE Antennas and Wireless Propagation Letters, 2005, vol. 4.

A. B. Abdel-Mooty Abdel-Rahman, Design and development of high gain wideband microstrip antenna and DGS filters using numerical experimentation approach, Fakultat Elektrotechnik und Informationstechnik der Otto-von-Guericke-Universitat Magdeburg, Jun. 1, 2005 (Thesis).

Kabacik, P. et al, Broadening the bandwidth in terminal antennas by tuning the coupling between the element and its ground, IEEE Antennas and Propagation Society International Symposium, Jul. 3, 2005.

Chen, Z.N. ; Liu, D. ; Gaucher, B.; Hildner, T., Reduction in antenna height by slotting ground plane, IWAT, Mar. 6, 2006.

Shum, K. M. ; Chan, C. H. ; Luk, K. M., Design of small antennas for Joypad applications, IWAT, Mar. 6, 2006.

Pozar, D, A Review of aperture coupled microstrip antennas: history, operation, development, and applications, University of Massachusetts at Amherst, 1996.

Kumar, G. Broadband microstrip antennas, Artech House, 2003.

Virga, K.L., Low-profile enhanced-bandwidth PIFA antennas for wireless communications packaging, IEEE Transactions on Microwave Theory and Techniques, 1997, vol. 45, No. 10.
Hong, J.S., Aperture-coupled microstrip open-loop resonators and their applications to the design of novel microstrip bandpass filters, IEEE Transactions on Microwave Theory and Techniques, 1999, vol. 47, No. 9.
Yang, F., Slitted small microstrip antenna, IEEE Antennas and Propagation Society International Symposium, 1998.
Lu, J.H., Slot-coupled small triangular microstrip antenna, Microwave and Optical Technology Letters, 1997, vol. 16, No. 6.
Anguera, J. et al. Stacked H-shaped microstrip patch antenna, IEEE Transactions on Antennas and Propagation, 2004, vol. 52, No. 4.
Okabe, H. Tunable antenna system for 1.9-GHz PCS handsets, IEEE Antennas and Propagation Society International Symposium, 2001.
Ottosen, D. Wideband aperture-fed patch antenna element, Master thesis at the Department of Electroscience, Lund Institute of Technology, Universitatis Carolina, 2004.
Cetiner, B. A packaged reconfigurable multielement antenna for wireless networking, Microwave Conference, 2001. APMC 2001. 2001 Asia-Pacific.
Anguera, J. Enhacing the performance of handset antennas by means of groundplane design, IEEE International Workshop on Antenna Technology Small Antennas and Novel Metamaterials, 2006.
Anguera, J. Multiband handset antennas by means of groundplane modification, IEEE International Workshop on Antenna Technology: Small Antennas and Novel Metamaterials (iWAT 2006). New York, USA, Mar. 2006.
Anguera,J. Multiband handset antenna behaviour by combining pifa and slot radiators, IEEE Antennas and Propagation Society International Symposium, Honolulu, Hawaii, USA, Jun. 2007.
Wong, K. L. Plannar antennas for wireless communications, John Wiley and Sons, 2003.
Lindberg, P. Wideband active and passive antenna solutions for handheld terminals, Acta Universitatis Upsaliensis, 2007.
Noguchi, K., A broadband plate antenna with slits, IEEE Antennas and Propagation Society International Symposium, 1999.
Kabacik, P. Potential advantage of using non rectangular ground in small antennas featuring wideband impedance match, EEE Antennas and Propagation Society International Symposium, Honolulu, Hawaii, USA, Jun. 2007.
Anguera, j. et al. Multiband handset antennas by means of groundplane modification, IEEE Antennas and Propagation Society International Symposium, Honolulu, Hawaii, USA, Jun. 2007.
Yoon, I.J., Frequency tunable antenna for mobile TV signal reception, IEEE Antennas and Propagation Society International Symposium 2006.
Lu, J.H., Slot-coupled compact triangular microstrip antenna with lumped load, IEEE Antennas and Propagation Society International Symposium, 1998.
Panaia, P., MEMS-Based reconfigurable antennas, IEEE, 2004.
Chen, Shih Chao, Office Action in U.S. Appl. No. 11/884,991 as mailed Jun. 16, 2010 (12 pages).
Paschen , D. ; Mayes , P. Structural stopband elimination with the monopole-slot antenna. Antenna Applications Symposium. Sep. 1982.
Chu , L. J. Physical limitations of omni-directional antennas. Journal of applied physics. vol. 19. Dec. 1948.
H.A. Wheeler, "Fundamental limitations of small antennas", Proc. IRE, pp. 1479-1488, Dec. 1947.

* cited by examiner

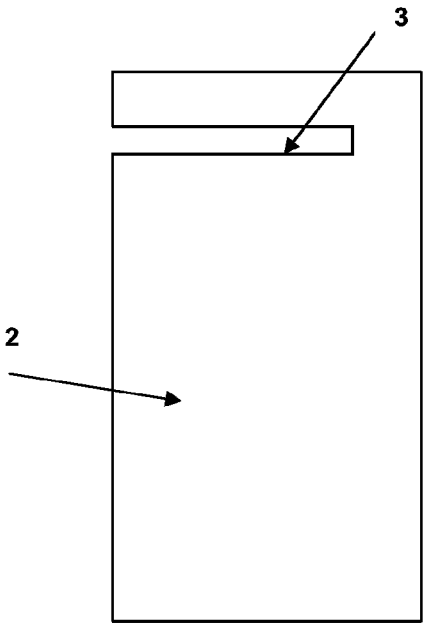
Fig. 9a
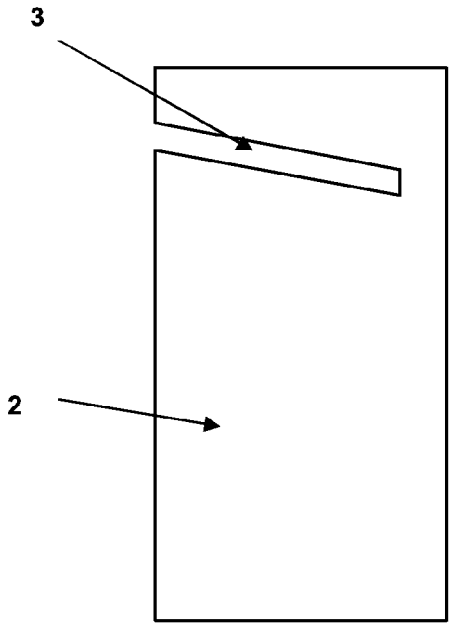
Fig. 9b
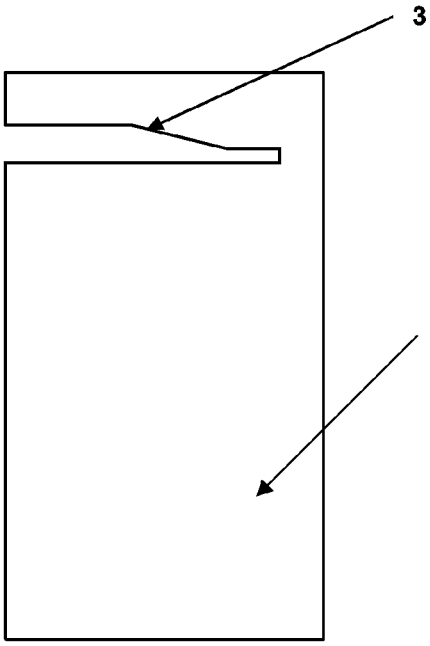
Fig. 9c
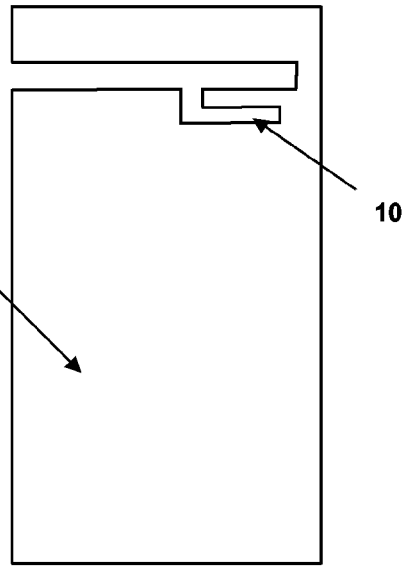
Fig. 9d
Fig. 9

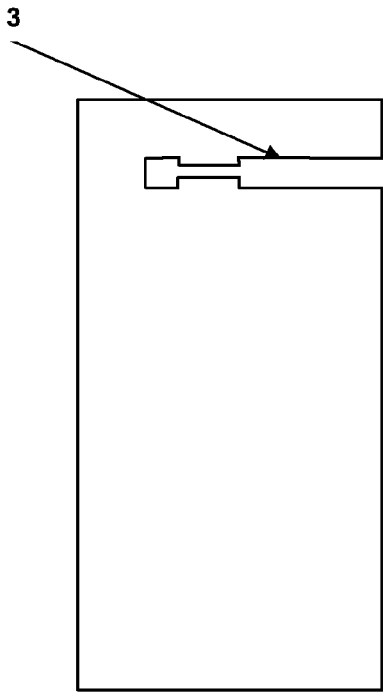
Fig. 10a
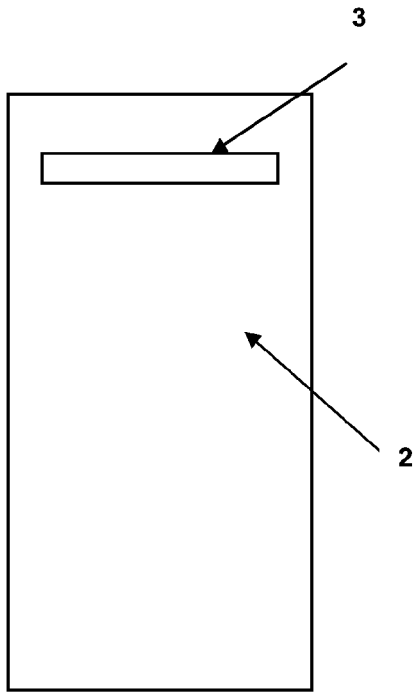
Fig. 10b
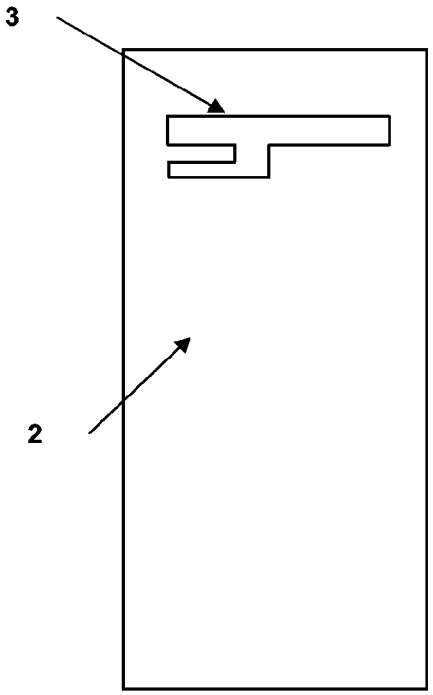
Fig. 10c
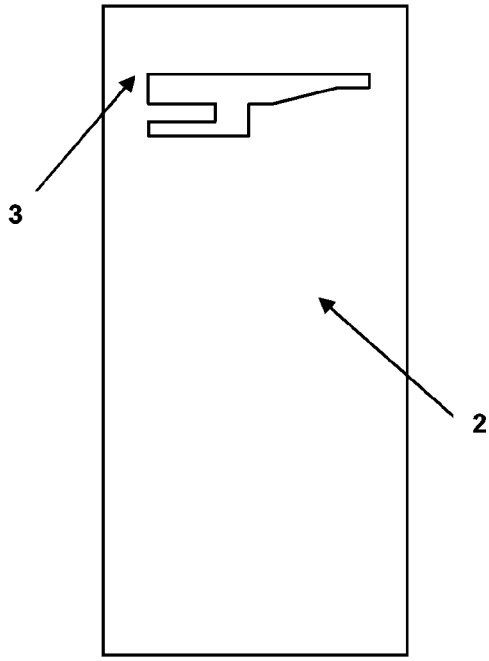
Fig. 10d
Fig. 10

SHAPED GROUND PLANE FOR RADIO APPARATUS

CROSS-REFERENCE TO RELATED APPLICATIONS

This patent application claims the benefit of priority from U.S. Provisional Patent Application No. 60/640,645 filed Dec. 30, 2004. This application incorporates by reference the entire disclosure of U.S. Provisional Patent Application No. 60/640,645.

This application is related to application number U.S. 60/640,645 filed on Dec. 30, 2004, in the U.S. and claims priority to that application, which is incorporated herein by reference.

The present invention refers to an antenna structure for a wireless device which comprises a ground plane and an antenna element. Further the invention refers to a wireless device with such an antenna structure and to a method for integrating such an antenna structure within a wireless device. The invention relates to a radio frequency (RF) ground plane used in combination with an antenna element placed inside a radio apparatus.

BACKGROUND OF THE INVENTION

In many applications, such as for instance mobile terminals and handheld devices, it is well known that the size of the device restricts the size of the antenna and its ground plane, which has a major effect on the overall antenna and terminal performance. In general terms, the bandwidth and efficiency of the antenna and terminal device are affected by the overall size, geometry, and dimensions of the antenna and the ground plane. A report on the influence of the ground plane size in the bandwidth of terminal antennas can be found in the publication "Investigation on Integrated Antennas for GSM Mobile Phones", by D. Manteuffel, A. Bahr, I. Wolff, Millennium Conference on Antennas & Propagation, ESA, AP2000, Davos, Switzerland, April 2000. In the prior art, most of the effort in the design of antennas including ground planes (for instance microstrip, planar inverted-F or monopole antennas) has been oriented to the design of the radiating element (that is, the microstrip patch, the PIFA element, or the monopole arm for the examples described above), yet providing a ground plane with a size and geometry that were mainly dictated by the size or aesthetics criteria according to every particular application.

Volume and size are typically an important aspect of a portable radio device, such as for instance a hand-held telephone (cellular phone, mobile/handset phones, smart phone, e-mail phone) or a wireless personal digital agenda (PDA) or computer. From the consumer's perspective the overall volume, mechanical design, ergonomics and aesthetics of the phone are critical. For instance, there has been an increasing trend in removing external antennas from handsets and substituting them by internal antennas that conveniently fit inside the phone. This solves the problem of removing a protruding part of the phone. External antennas feature several drawbacks: they can break accidentally under mechanical stress or shock and they make the phone more inconvenient and uncomfortable to carry inside a pocket and to extract it outside for operation. For the same reason, there is an increased trend in making slimmer, thinner phones that can better fit inside for instance a shirt or jacket pocket or a bag or case.

The desire to make smaller, thinner phones may conflict with the trend of adding more features to the phone. On one side, phones are increasingly adding components and features such as large color screens, digital cameras, digital music players (MP3, WAV), digital and analogue radio and multimedia broadcast receivers (FM/AM, DAB, SDARS, DMB), web browsers, QWERTY keyboards, satellite receivers and geolocalization systems (GPS, Galileo, Sirius, SDARS) and come with a wider range of form factors (candy bar phones, clamshell phones, flip-phones, slider phones, . . . ). Also, from the communication perspective, new cellular and wireless services are being added, which in some cases means that multiband capabilities are required (to feature several standards such as for instance CDMA, GSM850, GSM900, GSM1800, PCS1900, UMTS, WCDMA, Korean PCS) or that other connectivity components are to be included (for instance for Bluetooth, IEEE802.11 and IEEE802.16 services, WiFi, WiMax, ZigBee, Ultra WideBand). These trends put an increasing pressure on the antenna features, which need to feature a small footprint, a thin mechanical profile, yet performing efficiently at one or more frequency bands.

There is a well know trade-off between size of the antenna and performance. The fundamental limits on small antennas where theoretically established by H. Wheeler and L. J. Chu in the middle 1940's. They basically stated that a small antenna has a high quality factor (Q) because of the large reactive energy stored in the antenna vicinity compared to the radiated power. Such a high quality factor yields a narrow bandwidth; in fact, the fundamental derived in such theory imposes a maximum bandwidth given a specific size of a small antenna. Related to this phenomenon, it is also known that a small antenna features a large input reactance (either capacitive or inductive) that usually has to be compensated with an external matching/loading circuit or structure. It also means that is difficult to pack a resonant antenna into a space which is small in terms of the wavelength at resonance. Other characteristics of a small antenna are its small radiating resistance and its low efficiency.

Searching for structures that can efficiently radiate from a small space has an enormous commercial interest, especially in the environment of mobile communication devices (cellular telephony, cellular pagers, portable computers and data handlers, to name a few examples), where the size and weight of the portable equipments need to be small. According to R. C. Hansen (R. C. Hansen, "Fundamental Limitations on Antennas," Proc. IEEE, vol. 69, no. 2, February 1981), the performance of a small antenna depends on its ability to efficiently use the small available space inside the imaginary radian sphere surrounding the antenna.

The internal antenna of a cell phone usually takes the form of a substantially planar conducting element placed at a distance over the PCB substrate that includes the electronic circuitry of the handset. In most of the cases, one of the conducting ground layers in the PCB cover a substantial part or even the whole area of the footprint underneath the antenna. The advantage of this is that such a ground layer shields the antenna from the backward side of the PCB, therefore allowing for additional space for other components (such as for instance earpiece, vibrator, RF connectors, LCD screen, speakers, chips, RF and electronic circuitry . . . ) therefore allowing for a substantial integration and compactness of the whole device. One of the drawbacks of this is that having the antenna on one side of the PCB and other components on the back side of such a PCB implies a minimum thickness for the whole handset device.

Usually, antennas with a substantially planar conducting element placed at some distance over a ground layer are known as microstrip or patch antennas. Usually such microstrip and patch antennas include at least a feeding contact and a short to ground contact, forming a so called Planar Inverted F Antenna (PIFA). It is well known that the performance of such antennas is limited, in terms of bandwidth, efficiency and related parameters (gain, VSWR and so on) by the spacing between said conducting element and the ground layer: the shorter the distance between both, the smaller the bandwidth and efficiency. For the typical 5-15% bandwidths of a cellular/mobile system (GSM, UMTS, PCS, WCDMA), the minimum distance is about 2% of the longest operating wavelength (typical 7-9 mm), which again introduces a significant limitation in the development of thin, slim phones with multiple-band or wide-band operation.

DESCRIPTION OF THE INVENTION

For wireless devices it is desirable to miniaturize the antenna structures in order to allow for smaller wireless devices or for more room in the wireless devices for other components.

The object of the present invention is, therefore, to provide an antenna structure, a wireless device and a method to integrate an antenna structure which allows for a reduced size of the wireless devices with respect to known wireless devices.

This object is achieved for example by an antenna structure as of claim 1 and/or as of claim 7, a wireless device as of claim 35, a mobile phone as of claim 37 and the methods as of claims 40 and 41. Some other example embodiments are disclosed in the dependent claims.

The antenna structure of the present invention comprises a ground plane with at least one slot and an antenna element with at least one feeding connection and at least one ground connection. Said slot features a short end in the inner part of the ground plane, an open end on the perimeter of said ground plane, and a length close to a quarter wavelength with respect to at least one operating frequency. Said feeding and ground connections are placed respectively at the two different sides of said slot, and the distance of at least one of said connections to the short end of said slot is equal or smaller than an eighth of the wavelength.

The present invention describes a means to properly shape the ground plane of a cellular/wireless or generally a radio device as per enhancing the performance of the antenna and the whole device (in terms of bandwidth, VSWR, efficiency, total radiated power, sensitivity and so on) and/or reducing the antenna size and thickness (spacing with respect to the ground plane). The technology described herein relates generally to a family of antenna ground planes having a reduced size and enhanced performance based on the ground plane geometry and/or an innovative feeding technique. The slotted ground plane radiates together with the antenna element, contributing to the overall radiation and impedance performance (impedance level, resonant frequency, bandwidth . . . ).

The antenna structure of the invention comprises a ground plane with at least one slot wherein said slot is excited by means of the same feeding and ground connections that excite the antenna element. Said slot is excited directly and not by electromagnetic coupling as in prior art solutions, and therefore the antenna structure, that is, the set of antenna element and the slotted ground plane, radiates more efficiently.

The ground plane is properly shaped and combined with the antenna element to improve both the electrical and mechanical characteristics of the wireless device. Considering the ground plane of a radio apparatus as an integral part of it and as a part that can actively contribute to the radiation and impedance performance (impedance level, resonant frequency, bandwidth) a wireless device with an improved performance can be achieved.

The shaped ground plane may, for example, have utility in various wireless devices, including without limitation, the following types of devices:

- handheld terminals such as
  - cellular, mobile or cordless telephones,
  - Smartphones, PDAs,
  - electronic pagers
  - electronic games
  - or remote controls
- base station antennas (for instance for coverage in micro-cells or pico-cells for systems such as AMPS, GSM 900, GSM1800, UMTS, PCS1900, DCS, DECT, WLAN, . . . )
- car antennas.

Preferably the ground plane has at least one slot of a given length d. The distance of at least one of said connections (that is, either feeding or a ground connection, or even both a feeding and a ground connection) to the "short end" of said slot is equal or smaller than half the maximum length d of the slot. Also in other example embodiments said distance is equal or smaller than ⅓rd, ¼th, ⅕th, ⅐th, ⅛th, ⅒th, 1/20th or 1/30th of d. ⅓Relative to d, the distance of either the feeding or the ground connections or both feeding and ground connections to the "open end" of said slot is equal or larger than ½, ⅔rd, ¾th, ⅘th, ⅚th, ⅞th, 9/10th, 19/20th or 29/30th of d.

Arranging the antenna connections substantially close to said "short end" enables a proper direct coupling between the antenna element and the slot. The slot is excited and radiates more efficiently, therefore enhancing the radiation of the whole antenna structure. The result is that either the radiation features of the systems are enhanced (for instance bandwidth, number of radiating frequency bands, efficiency, VSWR, gain, radiation pattern, specific absorption rate), or that the antenna size can be reduced (thickness, footprint on PCB, spacing from ground plane, overall volume) while keeping or improving the radiation features.

It can be seen as well, that by placing feeding and ground connections close to the "short end" of the slot, said slot can be easily tuned to the reference impedance of the RF circuit.

Optionally one feeding connection is placed at the side of the slot closer to the RF module of the wireless device. Arranging the feeding connection at the side of the slot which is closer to the RF module the tracing of the electric connections on the circuit board (PCB) is simplified. Advantageously, the ground connection is placed on the side of the slot which is further away to the RF module, and is therefore placed further away the other end of the circuit board (PCB). As a result, the overall electrical length is increased and the bandwidth is increased.

The present invention also relates to an antenna structure that comprises a ground plane with at least one slot and an antenna element with at least one feeding connection and at least one ground connection. Said slot features at least two short ends in the inner part of the ground plane, and a length close to half wavelength with respect to at least one operating frequency. Said feeding and ground connections are placed respectively at the two different sides of said slot, and the distance of at least one of said connections to a short end of said slot is equal or smaller than a fourth of the wavelength.

Preferably the ground plane has at least one slot of a given length d. The distance of at least one of said connections (that is, a feeding or a ground connection, or even both a feeding and a ground connection) to a "short end" of said slot is equal or smaller than half the maximum length d of the slot. Also in other examples said distance is equal or smaller than ⅓rd, ¼th, ⅕th, ⅐th, ⅛th, ⅒th, 1/20th or 1/30th of d.

Relative to d, the distance of either the feeding or the ground connections or both feeding and ground connections to another "short end" of said slot is equal or larger than ½, ⅔rd, ¾th, ⅘th, ⅚th, ⅞th, 9/10th, 19/20th or 29/30th of d.

As stated here before arranging the antenna connections substantially close to one of said "short ends" enables a proper coupling between the antenna element and the slot, enhancing the radiation process. The result is that either the radiation features of the systems are enhanced or that the antenna size can be reduced while keeping or improving the radiation features.

Optionally one feeding connection is placed at the side of the slot closer to the RF module of the wireless device. Arranging the feeding connection at the side of the slot which is closer to the RF module the tracing of the electric connections on the circuit board (PCB) is simplified. Advantageously, the ground connection is placed on the side of the slot which is further away to the RF module, and is therefore placed further away the other end of the circuit board (PCB). As a result, the overall electrical length is increased and the bandwidth is increased.

The shaped ground plane can be combined with any antenna element featuring at least one feeding connection and one ground connection. In particular, it can be combined with a patch antenna, an inverted-F antenna, a Planar Inverted F Antenna or a monopole antenna.

In a particular embodiment the ground plane may be combined with an inverted F antenna (IFA) or planar inverted F antenna (PIFA). Such IFA, PIFA antenna elements some times take the form of straight 'F' (in case of the IFA) or polygonal plates (rectangular, square, circular, triangular, pentagonal, circular, elliptical in case of a PIFA element), but also take the form of some more complex shapes.

In some embodiments, the antenna element is an inverted-F antenna, and the feeding and ground connections are provided on the same plane containing the slot. Said feeding connection is an active transmitting and/or receiving RF port of the wireless device.

The ground plane may be embedded as one or more of the layers of a printed circuit board (PCB) included in the handset or wireless device. Typically all circuitry and main components are mounted on a main, backbone multilayer PCB.

Optionally the antenna structure may have a second separate ground plane. Said ground plane features a slot according to the present invention. By providing the antenna structure with an independent ground plane the design of the ground plane of the wireless device can be realized separately. The iterative and costly design of the ground place of the wireless device it is therefore not affected by the design of a suitable slotted ground plane for the optimal radiation of the antenna structure.

A simple example of a ground plane with at least one slot is a ground plane with a straight line slot. The length of said straight line slot may be close to half wavelength with respect to at least one operating frequency. By doing so a resonant frequency of the slot close or within the operating band or bands of the wireless device is obtained.

The ground plane may feature other more complex slots shaped as conformal, curved or bent shapes such as for instance 'L', 'Z', 'S', 'N' or 'M' like shapes.

In some embodiments, said at least one slot conformal shape is arranged such that the slot surrounds one or more other components on the circuit board (PCB) of the wireless device (for instance, cameras, shieldcans, earpiece or speakers, connectors, vibrators, electronic/RF components, chips, keyboards, screens, knobs, screws or other mechanical elements). Preferably said components are placed at a distance of the antenna element and/or the slot so that the antenna structure is not mistuned. Also preferably, said components are placed near a "short end" of the slotted ground plane.

In particular, in some embodiments a slot or a portion thereof takes the form of multilevel or space-filling geometries, of grid dimension or contour curves. The advantage of such a more complex forms is that the slot can be packed in a smaller footprint inside the wireless device and/or feature a multiband response, yet keeping and in some cases improving the performance of the wireless device when compared to the wireless device comprising a ground plane with a straight slot. In some other cases, the implementation of a straight slot will not be possible or practical, either because the handset or wireless device is too small, or because the operating wavelength is so long that the resonant slot would not fit within the PCB.

Some examples may also feature a ground plane with a slot or a branch of a slot of variable width. The width of the slot can be increased to improve for instance the bandwidth.

In some other examples, the ground plane features a slot that branches out onto two or more slots. In some examples one or more of such slots have an open end along the perimeter of the ground plane, while some others end in a short end or a voltage short in the inner conducting area of said ground plane. A multi-branch slot may provide enhanced multiband and/or broad/wideband radiation response for the handset or wireless device. The multi-branch slot structure may, for instance, be coupled to the antenna element by running at least a portion of a branch in between the feed and ground connections of the antenna element. In some examples, this coupling portion may be a main slot from which most of the other slots branch out. In other examples, the coupling portion may be a secondary branch of the structure.

Some other examples may also feature a ground plane with a multi-branch structure combined with a multiple-feed or multiple-ground antenna element, that is, an antenna element with two or more feeding connections and/or with two or more ground connections. Yet some other examples may feature a ground plane with a multi-branch structure combined with multiple antenna elements.

Preferably, the multi-branch slot will be coupled to the antenna element or elements such that a feeding connection and/or a ground connection of the antenna elements are placed substantially close to a "short end" of at least one branch of the multi-branch slot.

In some examples, the antenna element is substantially flat and is arranged substantially parallel to the portion of the ground plane which is located closest to the antenna element.

The ground plane and the antenna element may be provided on the same and/or on opposite sides of the circuit board. If they are provided on opposite sides, then the circuit board allows for a defined separation between the ground plane and the antenna element.

The ground plane may also be provided as a rigid or at least partially rigid conductor. It may be a stamped metal piece, a bent metal material like a metal ring or the like.

It is also possible that the ground plane is provided as a flexible, or at least partially flexible conducting material, such as a web material, a wire which is preferably flat, a court, a fold, a lace, a string, or the like. This allows for the integration of the ground plane e.g. into textile materials.

The antenna structure according to the invention may feature a ground plane which totally or in part takes the form of a multilevel structure, a space-filling curve, a grid dimension curve or a contour curve. The advantage of such a more complex structures and curves is that the ground plane can be packed in a smaller footprint inside the wireless device and/or feature a multiband response, yet keeping and in some cases improving the performance of the device.

The antenna element itself may also be provided in the shape of a multilevel structure, a space-filling curve, a grid dimension curve, or a contour curve.

It should be understood that the antenna structure according to the invention may be used for one or several cellular standards and communication systems, such as Bluetooth, UltraWideBand (UWB), WiFi (IEEE802.11a,b,g), WiMAX (IEEE802.16), PMG, digital radio and television devices (DAB, DBTV, DVB-H), satellite systems such as GPS, Galileo, SDARS, GSM900, GSM1800, PCS1900, Korean PCS (KPCS), CDMA, WCDMA, UMTS, 3G, GSM850, ZigBee (868 and/or 915), and/or other applications.

Further the invention refers to a corresponding wireless device. This wireless device may be made smaller than comparable wireless devices. This wireless device can be for instance a handheld terminal (cellular or cordless telephones, PDAs, electronic pagers, electronic games, or remote controls), base station antennas (for instance for coverage in micro-cells or pico-cells for systems such as AMPS, GSM900, GSM1800, UMTS, PCS1900, DCS, DECT, WLAN, . . . ) and car antennas.

The invention also refers to a slim mobile phone. By slim mobile phone, we refer to a mobile phone whose maximum width is equal or smaller than 14 mm. Yet some other sources refer to a mobile phone as being a slim mobile phone when its maximum width w is equal or smaller than 12, 11, 10, 9, 8 or even 7 mm.

The mobile phone may be a bar-phone, a clamshell or flip-phone, a slider phone, etc. . . .

Another aspect of the invention refers to a method to integrate an antenna structure in a wireless device, comprising the steps of:

providing a ground plane to said wireless device, providing said ground plane with a slot of a length substantially close to a quarter wavelength with respect to at least one operating frequency within said antenna structure and featuring a short end in the inner part of the ground plane and an open end on the perimeter of said ground plane, tuning said slot by placing at least one feeding and at least one ground connection respectively at the two different sides of said slot, and at a distance to the short end of said slot equal or smaller than an eighth of the wavelength, and designing and providing an antenna element to said wireless device.

Yet one more aspect of the invention refers to a method to integrate an antenna structure in a wireless device, comprising the steps of:

providing a ground plane to said wireless device, providing said ground plane with a slot of a length substantially close to half wavelength with respect to at least one operating frequency within said antenna structure and featuring at least two short ends, tuning said slot by placing at least one feeding and at least one ground connection respectively at the two different sides of said slot, and at a distance to the short end of said slot equal or smaller than a quarter of the wavelength, and designing and providing an antenna element to said wireless device.

It is an advantage of the antenna structure of the present invention and of the method to integrate said antenna structure in a wireless device that the antenna structure can be finely tuned by slightly modifying the size and shape of the slot and/or by accurately placing the feeding and ground connections. A significant cost saving can be achieved since the same radiating element (the antenna element) can be used and customized for a certain wireless device by only shaping the slot and/or placing the feeding and ground connections with respect to it. Together with the cost savings, the development time and time to market are reduced.

An antenna element covering the main communication systems may be used in combination with the slotted ground plane of the present invention, the resulting antenna structure covering the major current and future wireless services, opening this way a wide range of possibilities in the design of universal, multi-purpose, wireless terminals and devices that can transparently switch or simultaneously operate within all said services.

The ground plane may be embedded as one or more of the layers of a printed circuit board (PCB) included in the handset or wireless device. Typically all circuitry and main components are mounted on a main, backbone multilayer PCB. By embedding the slotted ground plane according to the present invention, in one of the layers of such a PCB, the manufacturing cost of embedding such a solution is practically inexistent, while the device becomes mechanically more robust and easy to manufacture.

The ground plane, the slot, the antenna element or a portion of any of them may be provided in the shape of a multilevel structure, a space-filling curve, a grid dimension curve, or a contour curve. A throughout description of such multilevel or space-filling structures can be found in "Multilevel Antennas" (Patent Publication No. WO01/22528) and "Space-Filling Miniature Antennas" (Patent Publication No. WO01/54225). In the following, some terms used throughout the description and the claims shall be explained in more detail.

Space Filling Curves

In one example, the ground plane or one or more of the ground plane elements or ground plane parts may be miniaturized by shaping at least a portion of the conductor as a space-filling curve (SFC). Examples of space-filling curves are shown in FIG. 11*b* (see curves 1501 to 1514). A SFC is a curve that is large in terms of physical length but small in terms of the area in which the curve can be included. Space-filling curves fill the surface or volume where they are located in an efficient way while keeping the linear properties of being curves. In general space-filling curves may be composed of straight, essentially straight and/or curved segments. More precisely, for the purposes of this patent document, a SFC may be defined as follows: a curve having at least five segments that are connected in such a way that each segment forms an angle with any adjacent segments, such that no pair of adjacent segments defines a larger straight segment. In addition, a SFC does not intersect with itself at any point except possibly the initial and final point (that is, the whole curve can be arranged as a closed curve or loop, but none of the lesser parts of the curve form a closed curve or loop). A closed loop may form a sub-portion of the open loop ground plane.

A space-filling curve can be fitted over a flat or curved or folded or bent or twisted surface, and due to the angles between segments, the physical length of the curve is larger than that of any straight line that can be fitted in the same area (surface) as the space-filling curve. Additionally, to shape the structure of a miniature ground plane, the segments of the SFCs should be shorter than at least one fifth of the free-space operating wavelength, and possibly shorter than one tenth of the free-space operating wavelength. The space-filling curve should include at least five segments in order to provide some ground plane size reduction, however a larger number of segments may be used. In general, the larger the number of segments and the narrower the angles between them, the smaller the size of the final ground plane.

A SFC may also be defined as a non-periodic curve including a number of connected straight or essentially straight segments smaller than a fraction of the operating free-space wavelength, where the segments are arranged in such a way that no adjacent and connected segments form another longer straight segment and wherein none of said segments intersect each other.

In one example, a ground plane geometry forming a space-filling curve may include at least five segments, each of the at least five segments forming an angle with each adjacent segment in the curve, at least three of the segments being shorter than one-tenth of the longest free-space operating wavelength of the ground plane. Preferably each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the ground plane. Some space-filling curves might approach a self-similar or self-affine curve, while some others would rather become dissimilar, that is, not displaying self-similarity or self-affinity at all (see for instance 1510, 1511, 1512).

Box-Counting Curves

In another example, the ground plane or one or more of the ground plane elements or ground plane parts may be miniaturized by shaping at least a portion of the conductor to have a selected box-counting dimension. For a given geometry lying on a surface, the box-counting dimension is computed as follows. First, a grid with rectangular or substantially squared identical boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of this document, the box-counting dimension may be computed by placing the first and second grids inside a minimum rectangular area enclosing the conductor of the ground plane and applying the above algorithm. The first grid in general has n×n boxes and the second grid has 2n×2n boxes matching the first grid. The first grid should be chosen such that the rectangular area is meshed in an array of at least 5×5 boxes or cells, and the second grid should be chosen such that L2=½ L1 and such that the second grid includes at least 10×10 boxes. The minimum rectangular area is an area in which there is not an entire row or column on the perimeter of the grid that does not contain any piece of the curve. Further the minimum rectangular area preferably refers to the smallest possible rectangle that completely encloses the curve or the relevant portion thereof.

An example of how the relevant grid can be determined is shown in FIG. 11*c* to 11*e*. In FIG. 11*c* a box-counting curve is shown in it smallest possible rectangle that encloses that curve. The rectangle is divided in a n×n (here as an example 5×5) grid of identical rectangular cells, where each side of the cells corresponds to 1/n of the length of the parallel side of the enclosing rectangle. However, the length of any side of the rectangle (e.g. Lx or Ly in FIG. 11*d*) may be taken for the calculation of D since the boxes of the second grid (see FIG. 11*e*) have the same reduction factor with respect to the first grid along the sides of the rectangle in both directions (x and y direction) and hence the value of D will be the same no matter whether the shorter (Lx) or the longer (Ly) side of the rectangle is taken into account for the calculation of D. In some rare cases there may be more than one smallest possible rectangle. In this case the smallest possible rectangle giving the smaller value of D is chosen.

Alternatively the grid may be constructed such that the longer side (see left edge of rectangle in FIG. 11*c*) of the smallest possible rectangle is divided into n equal parts (see L1 on left edge of grid in FIG. 11*f*) and the n×n grid of squared boxes has this side in common with the smallest possible rectangle such that it covers the curve or the relevant part of the curve. In FIG. 11*f* the grid therefore extends to the right of the common side. Here there may be some rows or columns which do not have any part of the curve inside (See the ten boxes on the right hand edge of the grid in FIG. 11*f*). In FIG. 11*g* the right edge of the smallest rectangle (See FIG. 11*c*) is taken to construct the n×n grid of identical square boxes. Hence, there are two longer sides of the rectangular based on which the n×n grid of identical square boxes may be constructed and therefore preferably the grid of the two first grids giving the smaller value of D has to be taken into account.

If the value of D calculated by a first n×n grid of identical rectangular boxes (FIG. 11*d*) inside of the smallest possible rectangle enclosing the curve and a second 2n×2n grid of identical rectangular boxes (FIG. 11*e*) inside of the smallest possible rectangle enclosing the curve and the value of D calculated from a first n×n grid of squared identical boxes (see FIG. 11*f* or FIG. 11*g*) and a second 2n×2n grid of squared identical boxes where the grid has one side in common with the smallest possible rectangle, differ, then preferably the first and second grid giving the smaller value of D have to be taken into account.

Alternatively a curve may be considered as a box counting curve if there exists no first n×n grid of identical square or identical rectangular boxes and a second 2n×2n grid of identical square or identical rectangular boxes where the value of D is smaller than 1.1, 1.2, 1.25, 1.3, 1.4, 1.5, 1.6, 1.7, 1.8, 1.9, 2.0, 2.1, 2.2, 2.3, 2.4, 2.5, 2.6, 2.7, 2.8, or 2.9.

In any case, the value of n for the first grid should not be more than 5, 7, 10, 15, 20, 25, 30, 40 or 50.

The desired box-counting dimension for the curve may be selected to achieve a desired amount of miniaturization. The box-counting dimension should be larger than 1.1 in order to achieve some ground plane size reduction. If a larger degree of miniaturization is desired, then a larger box-counting dimension may be selected, such as a box-counting dimension ranging from 1.5 to 2 for surface structures, while ranging up to 3 for volumetric geometries. For the purposes of this patent document, curves in which at least a portion of the geometry of the curve or the entire curve has a box-counting dimension larger than 1.1 may be referred to as box-counting curves.

For very small ground planes, for example ground planes that fit within a rectangle having a maximum size equal to one-twentieth the longest free-space operating wavelength of the antenna structure, the box-counting dimension may be computed using a finer grid. In such a case, the first grid may include a mesh of 10×10 equal cells, and the second grid may include a mesh of 20×20 equal cells. The grid-dimension (D) may then be calculated using the above equation.

In general, for a given resonant frequency of the antenna structure, the larger the box-counting dimension, the higher the degree of miniaturization that will be achieved by the ground plane.

One way to enhance the miniaturization capabilities of the ground plane (that is, reducing size while maximizing bandwidth, efficiency and gain of the antenna structure) is to arrange the several segments of the curve of the ground plane pattern in such a way that the curve intersects at least one point of at least 14 boxes of the first grid with 5×5 boxes or cells enclosing the curve (This provides for an alternative definition of a box counting curve). If a higher degree of miniaturization is desired, then the curve may be arranged to cross at least one of the boxes twice within the 5×5 grid, that is, the curve may include two non-adjacent portions inside at least one of the cells or boxes of the grid (Another alternative for defining a box counting curve). The relevant grid here may be any of the above mentioned constructed grids or may be any grid. That means if any 5×5 grid exists with the curve crossing at least 14 boxes or crossing one or more boxes twice the curve may be said to be a box counting curve.

FIG. 11*a* illustrates an example of how the box-counting dimension of a curve 31 is calculated. The example curve 31 is placed under a 5×5 grid 2 (FIG. 11*a* upper part) and under a 10×10 grid 33 (FIG. 11*a* lower part). As illustrated, the curve 31 touches N1=25 boxes in the 5×5 grid 32 and touches N2=78 boxes in the 10×10 grid 33. In this case, the size of the boxes in the 5×5 grid 32 is twice the size of the boxes in the 10×10 grid 33. By applying the above equation, the box-counting dimension of the example curve 31 may be calculated as D=1.6415. In addition, further miniaturization is achieved in this example because the curve 31 crosses more than 14 of the 25 boxes in grid 32, and also crosses at least one box twice, that is, at least one box contains two non-adjacent segments of the curve. More specifically, the curve 31 in the illustrated example crosses twice in 13 boxes out of the 25 boxes.

The terms explained above can be also applied to curves that extend in three dimensions. If the extension in the third dimension is rather small the curve will fit into a n×n×1 arrangement of 3D-boxes (cubes of size L1×L1×L1) in a plane. Then the calculations can be performed as described above. Here the second grid will be a 2n×2n×1 grid of cuboids of size L2×L2×L1. If the extension in the third dimension is larger a n×n×n first grid and an 2n×2n×2n second grid will be taken into account. The construction principles for the relevant grids as explained above for two dimensions apply equally in three dimensions.

The box counting curve preferably is non-periodic. This applies at least to a portion of the box counting curve which is located in an area of more than 30%, 50%, 70%, or 90% of the area which is enclosed by the envelope of the box counting curve.

Grid Dimension Curves

In another example, the ground plane or one or more ground plane elements or ground plane parts may be miniaturized by shaping at least a portion of the conductor to include a grid dimension curve. For a given geometry lying on a planar or curved surface, the grid dimension of the curve may be calculated as follows. First, a grid with substantially square identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of this document, the grid dimension may be calculated by placing the first and second grids inside the minimum rectangular area enclosing the curve of the ground plane and applying the above algorithm. The minimum rectangular area is an area in which there is not an entire row or column on the perimeter of the grid that does not contain any piece of the curve.

The first grid may, for example, be chosen such that the rectangular area is meshed in an array of at least 25 substantially equal preferably square cells. The second grid may, for example, be chosen such that each cell of the first grid is divided in 4 equal cells, such that the size of the new cells is L2=½ L1, and the second grid includes at least 100 cells.

Depending on the size and position of the squares of the grid the number of squares of the smallest rectangular may vary. A preferred value of the number of squares is the lowest number above or equal to the lower limit of 25 identical squares that arranged in a rectangular or square grid cover the curve or the relevant portion of the curve. This defines the size of the squares. Other preferred lower limits here are 50, 100, 200, 250, 300, 400 or 500. The grid corresponding to that number in general will be positioned such that the curve touches the minimum rectangular at two opposite sides. The grid may generally still be shifted with respect to the curve in a direction parallel to the two sides that touch the curve. Of such different grids the one with the lowest value of D is preferred. Also the grid whose minimum rectangular is touched by the curve at three sides (see as an example FIG. 11*f* and FIG. 11*g*) is preferred. The one that gives the lower value of D is preferred here.

The desired grid dimension for the curve may be selected to achieve a desired amount of miniaturization. The grid dimension should be larger than 1 in order to achieve some ground plane size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve or a curve where at least a portion of that curve is having a grid dimension larger than 1 may be referred to as a grid dimension curve.

In general, for a given resonant frequency of the antenna structure, the larger the grid dimension the higher the degree of miniaturization that will be achieved by the ground plane.

One example way of enhancing the miniaturization capabilities of the ground plane (which provides for an alternative way for defining a grid dimension curve) is to arrange the several segments of the curve of the ground plane pattern in such a way that the curve intersects at least one point of at least 50% of the cells of the first grid with at least 25 cells (preferably squares) enclosing the curve. In another example, a high degree of miniaturization may be achieved (giving another alternative definition for grid dimension curves) by arranging the ground plane such that the curve crosses at least one of the cells twice within the 25 cell grid (of preferably squares), that is, the curve includes two non-adjacent portions inside at least one of the cells or cells of the grid. In general the grid may have only a line of cells but may also have at least 2 or 3 or 4 columns or rows of cells.

FIG. 12 shows an example two-dimensional ground plane forming a grid dimension curve with a grid dimension of approximately two. FIG. 13 shows the ground plane of FIG. 12 enclosed in a first grid having thirty-two (32) square cells, each with a length L1. FIG. 14 shows the same ground plane enclosed in a second grid having one hundred twenty-eight (128) square cells, each with a length L2. The length (L1) of each square cell in the first grid is twice the length (L2) of each square cell in the second grid (L1=2×L2). An examination of FIG. 13 and FIG. 14 reveal that at least a portion of the ground plane is enclosed within every square cell in both the first and second grids. Therefore, the value of N1 in the above grid dimension (Dg) equation is thirty-two (32) (i.e., the total number of cells in the first grid), and the value of N2 is one hundred twenty-eight (128) (i.e., the total number of cells in the second grid). Using the above equation, the grid dimension of the ground plane may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

For example, FIG. 15 shows the same ground plane as of FIG. 12 enclosed in a third grid with five hundred twelve (512) square cells, each having a length L3. The length (L3) of the cells in the third grid is one half the length (L2) of the cells in the second grid, shown in FIG. 14. As noted above, a portion of the ground plane is enclosed within every square cell in the second grid, thus the value of N for the second grid is one hundred twenty-eight (128). An examination of FIG. 15, however, reveals that the ground plane is enclosed within only five hundred nine (509) of the five hundred twelve (512) cells of the third grid. Therefore, the value of N for the third grid is five hundred nine (509). Using FIG. 14 and FIG. 15, a more accurate value for the grid dimension (D) of the ground plane may be calculated as follows:

$$D_g = -\frac{\log(509) - \log(128)}{\log(2 \times L2) - \log(L2)} \approx 1.9915$$

It should be understood that a grid-dimension curve does not need to include any straight segments. Also, some grid-dimension curves might approach a self-similar or self-affine curves, while some others would rather become dissimilar, that is, not displaying self-similarity or self-affinity at all (see for instance FIG. 12).

The terms explained above can be also applied to curves that extend in three dimensions. If the extension in the third dimension is rather small the curve will fit into an arrangement of 3D-boxes (cubes) in a plane. Then the calculations can be performed as described above. Here the second grid will be composed in the same plane of boxes with the size L2×L2×L1.

If the extension in the third dimension is larger a m×n×o first grid and an 2m×2n×2o second grid will be taken into account. The construction principles for the relevant grids as explained above for two dimensions apply equally in three dimensions. Here the minimum number of cells preferably is 25, 50, 100, 125, 250, 400, 500, 1000, 1500, 2000, 3000, 4000 or 5000.

The grid dimension curve preferably is non-periodic. This applies at least to a portion of the grid dimension curve which is located in an area of more than 30%, 50%, 70%, or 90% of the area which is enclosed by the envelope of the grid dimension curve.

Contour Curve

The contour-curve is defined by the ratio Q=C/E given by the ratio of the length C of the circumference of the curve and of the largest extension E of said curve. The circumference is determined by all the borders (the contour) between the inside and the outside of the curve.

The largest extension E is determined by the diameter of the smallest circle, which encloses the curve entirely.

The more complex the curve, the higher the ratio Q. A high value of Q is advantageous in terms of miniaturization.

If the curve is on a folded, bent or curved or otherwise irregular surface, or is provided in any another three-dimensional fashion (i.e. it is not planar), the ratio Q is determined by the length C of the circumference of the orthogonal projection of the curve onto a planar plane. The corresponding largest extension E is also determined from this projection onto the same planar plane. The plane preferably lies in such a way in relation to the three-dimensional curve that the line, which goes along the largest extension F of the three-dimensional curve, lies in the plane (or a parallel and hence equivalent plane). The largest extension F of the three-dimensional curve lies along the line connecting the extreme points of the curve, which contact a sphere, which is given by the smallest possible sphere including the entire curve. Further the plane is oriented preferably in such a way, that the outer border of the projection of the curve onto the plane covers the largest possible area. Other preferred planes are those on which the value of C or Q of the projection onto that plane is maximized.

If for a three-dimensional curve a single projection plane is given in which the ratio Q of the projection of the curve onto the plane is larger than the specified minimal value or this is the case for one of the above mentioned preferred projection planes the curve is said to be a contour curve. Possible minimum values for Q are 2.1, 2.25, 2.5, 2.75, 3.0, 3.1, 3.2, 3.25, 3.3, 3.5, 3.75, 4.0, 4.5, 5.0, 6, 7, 8, 9, 10, 12, 15, 20, 25, 30, 40, 50, 75, and 100.

The contour curve preferably is non-periodic. This applies at least to a portion of the contour curve which is located in an area of more than 30%, 50%, 70%, or 90% of the area which is enclosed by the envelope of the contour curve (or the above mentioned projection thereof).

Multilevel Structures

In another example, at least a portion of the conductor of the ground plane may be coupled, either through direct contact or electromagnetic coupling, to a conducting surface, such as a conducting polygonal or multilevel surface. Further the shape of the ground plane may include the shape of a multilevel structure. A multilevel structure is formed by gathering several geometrical elements such as polygons or polyhedrons of the same type or of different type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling these structures to each other electromagnetically, whether by proximity or by direct contact between elements.

At least two of the elements may have a different size. However, also all elements may have the same or approximately the same size. The size of elements of a different type may be compared by comparing their largest diameter.

The majority of the component elements of a multilevel structure have more than 50% of their perimeter (for polygons) or of their surface (for polyhedrons) not in contact with any of the other elements of the structure. Thus, the component elements of a multilevel structure may typically be identified and distinguished, presenting at least two levels of detail: that of the overall structure and that of the polygon or polyhedron elements which form it. Additionally, several multilevel structures may be grouped and coupled electromagnetically to each other to form higher level structures. In a single multilevel structure, all of the component elements are polygons with the same number of sides or are polyhedrons with the same number of faces. However, this characteristic may not be true if several multilevel structures of different natures are grouped and electromagnetically coupled to form meta-structures of a higher level.

A multilevel ground plane includes at least two levels of detail in the body of the ground plane: that of the overall structure and that of the majority of the elements (polygons or polyhedrons) which makes it up. This may be achieved by ensuring that the area of contact or intersection (if it exists) between the majority of the elements forming the ground plane is only a fraction of the perimeter or surrounding area of said polygons or polyhedrons.

One example property of a multilevel ground plane is that the radioelectric behavior of the ground plane can be similar in more than one frequency band. Input parameters (e.g., impedance) and radiation patterns remain similar for several frequency bands (i.e., the antenna structure has the same level of adaptation or standing wave relationship in each different band), and often the antenna structure present almost identical radiation diagrams at different frequencies. The number of frequency bands is proportional to the number of scales or sizes of the polygonal elements or similar sets in which they are grouped contained in the geometry of the main radiating element.

In addition to their multiband behavior, multilevel structure ground plane may have a smaller than usual size as compared to other ground plane of a simpler structure (such as those consisting of a single polygon or polyhedron). Additionally, the edge-rich and discontinuity-rich structure of a multilevel ground plane may enhance the radiation process, relatively increasing the radiation resistance of the ground plane and reducing the quality factor Q ,i.e. increasing its bandwidth.

A multilevel ground plane structure may be used in many antenna structure configurations, such as dipoles, monopoles, patch or microstrip antennae, coplanar antennae, reflector antennae, aperture antennae, antenna arrays, or other antenna configurations. In addition, multilevel ground plane structures may be formed using many manufacturing techniques, such as printing on a dielectric substrate by photolithography (printed circuit technique); dieing on metal plate, repulsion on dielectric, or others.

BRIEF DESCRIPTION OF THE DRAWINGS

Embodiments of the invention are shown in the enclosed drawings. Herein shows:

FIG. 3 schematic views of slotted ground planes;

FIG. 5 3-dimensional view of an antenna structure for a wireless device with a slotted ground plane featuring two short ends and also showing an RF module;

FIG. 6 3-dimensional view of an antenna structure for a wireless device with a slotted ground plane featuring a slot of variable width with an open end and a short end;

FIG. 9 schematic views of slotted ground planes according to the invention;

FIG. 10 other schematic views of slotted ground planes according to the invention;

Figure 1:
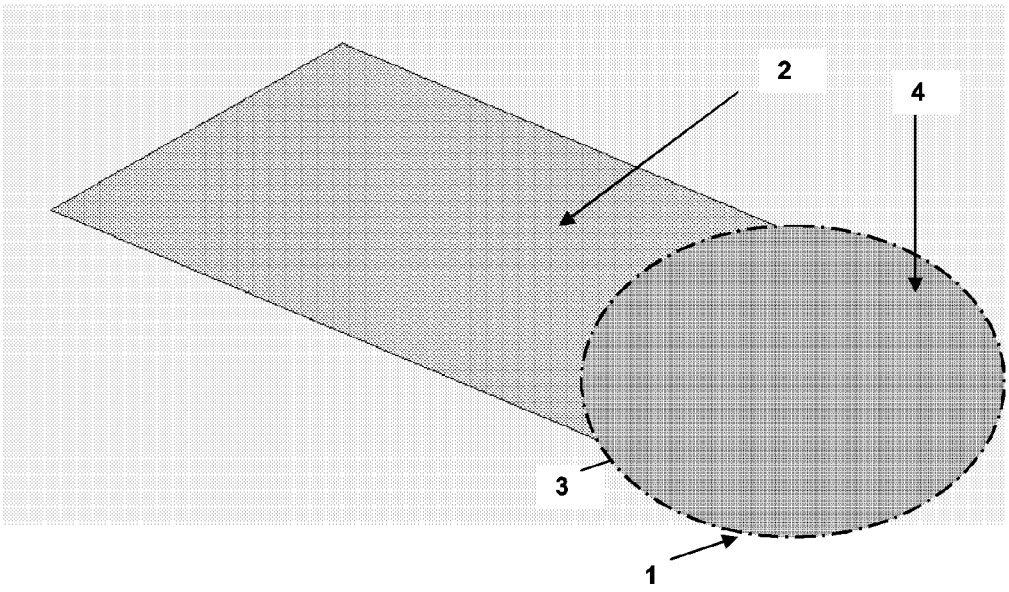
FIG. 1 3-dimensional view of an antenna structure for a wireless device according to the present invention.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

DESCRIPTION OF EXAMPLE EMBODIMENTS

FIGS. 1-10, illustrate examples of an antenna structure for a wireless device, comprising a slotted ground plane 2 comprising at least one slot 3 and an antenna element 4 with at least one feeding 5 and one ground 6 connection.

FIG. 1 shows an example of an antenna element 4 and a slotted ground plane 2. The conducting ground plane 2, is typically embedded on the PCB of a wireless device. A straight slot 3 on the ground plane 2 features an open end 8 and a short end 7. An antenna element 4 is placed over the ground plane 2. Such an antenna element 4 features a substantially planar conducting surface with two substantially vertical connections. In this example, both connections are substantially close to the short end 7 of the slot 3. In particular the distance to the short end 7 is smaller than half of the length of the slot 3 about ⅓rd the length of the slot 3. As a result the set 1 of antenna element 4 and the slotted ground plane 2 radiates more efficiently.

Figure 2:
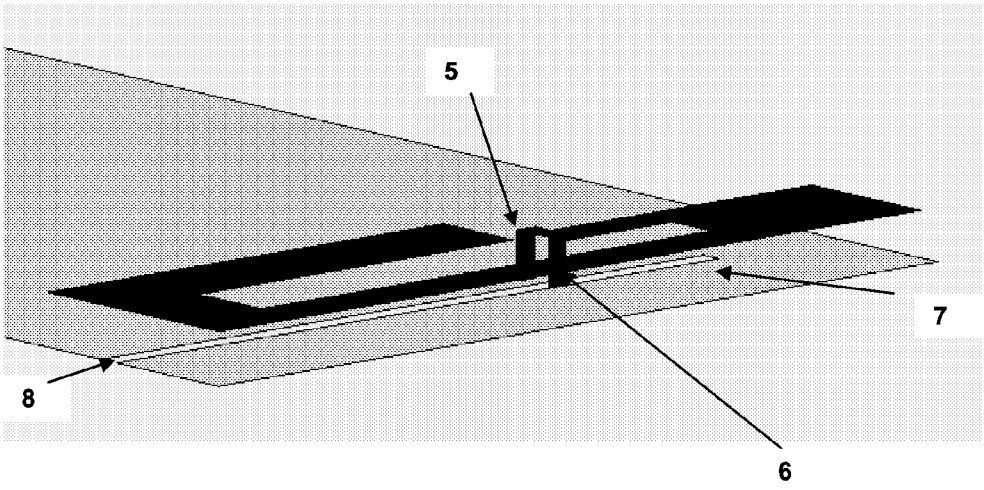
FIG. 2 close-up of the 3-dimensional view of an antenna structure of FIG. 1.

FIG. 2 shows a close-up of the antenna structure of FIG. 1. The open end 8 and short end 7 of the straight slot 3 on the ground plane 2 can be clearly seen in this close-up. The vertical connections show respectively the feeding 5 connection and the ground 6 connection of the antenna element 4. Each of those connections of the antenna element 4 are placed at opposite sides of the slot 3.

Figure 3:
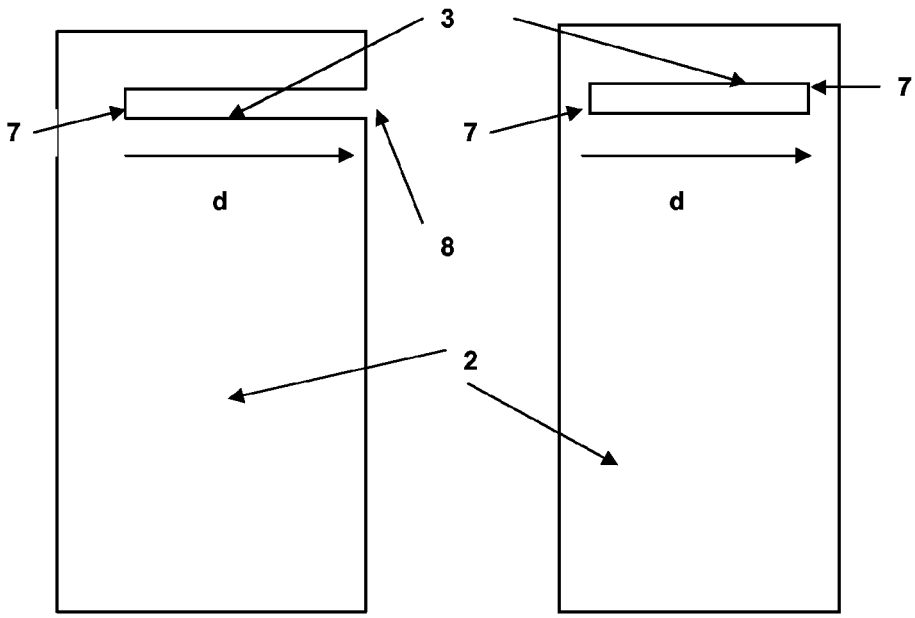

FIG. 3 shows schematic views of slotted ground planes 2. The ground plane 2 on the left hand side depicts a ground plane 2, with a straight slot 3 featuring a short end 7 in the inner part of the ground plane 2, and an open end 8 on the perimeter of said ground plane 2. Said slot 3 has a length d substantially close to a quarter wavelength with respect to at least one operating frequency within said antenna structure.

The ground plane 2 on the right hand side depicts a ground plane 2, with a straight slot 3 featuring two short ends 7 in the inner part of the ground plane 2. Said slot 3 has a length d substantially close to half wavelength with respect to at least one operating frequency within said antenna structure.

Figure 4:
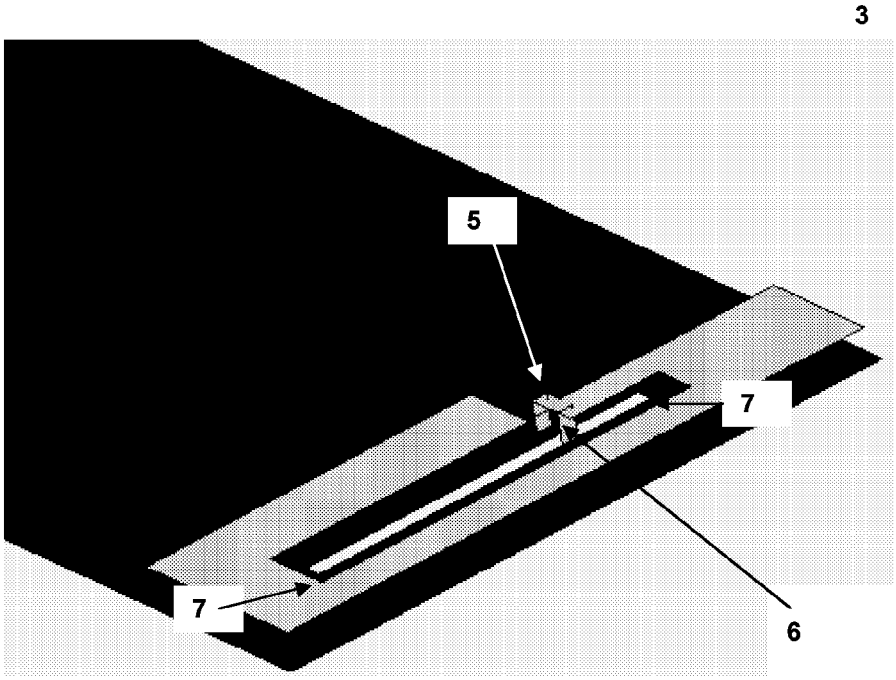
FIG. 4 close-up of a 3-dimensional view of an antenna structure for a wireless device with a slotted ground plane featuring two short ends.

FIG. 4 shows another example of an antenna structure comprising an antenna element 4 and a slotted ground plane 2. The conducting ground plane 2 is typically embedded on the PCB of a wireless device. The ground plane 2 features a straight slot 3 with two "short ends". A Planar Inverted F Antenna element 4 is placed over the ground plane 2. In this example, both connections are substantially close to one of the "short ends" of the slot 3. In particular the distance is smaller than half of the length of the slot 3 about ¼th the length of the slot 3*d*. The vertical connections show respectively the feeding 5 connection and the ground 6 connection of the antenna element 4. Each of those connections of the antenna element 4 are placed at opposite sides of the slot 3.

Figure 5:
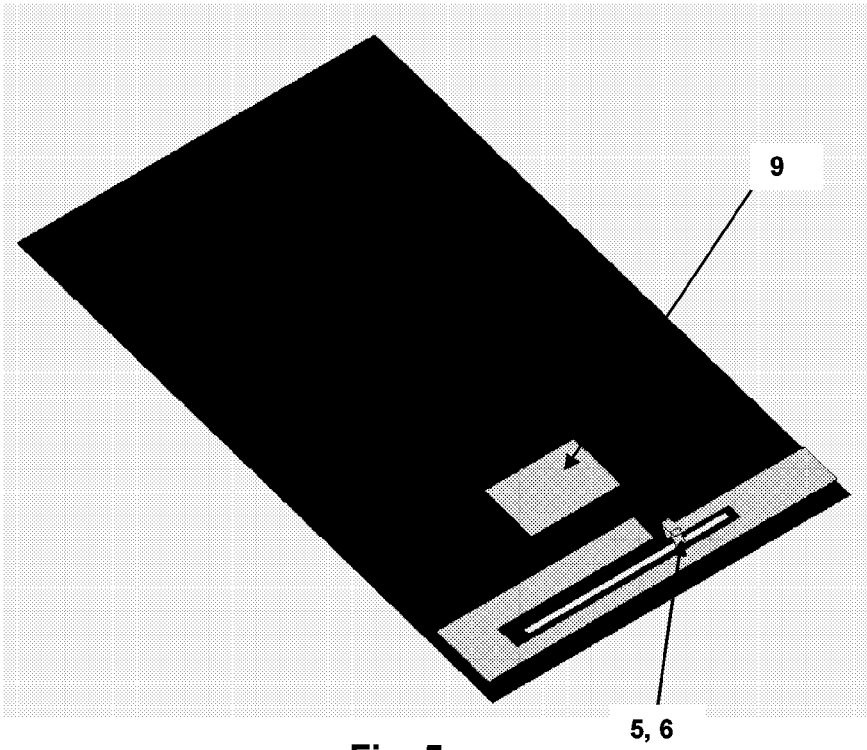

FIG. 5 shows a schematic view of the antenna structure of FIG. 4. It shows the RF module 9 of a wireless device. It can be seen that the feeding 5 connection is placed at the side of the slot 3 closer to the RF module 9 of the wireless device. Arranging the feeding 5 connection at the side of the slot 3 which is closer to the RF module 9 the tracing of the electric connections on the circuit board (PCB) is simplified. It is also shown that the ground 6 connection is placed on the side of the slot 3 which is further away to the RF module 9, and is therefore placed further away the other end of the circuit board (PCB). As a result, the overall electrical length is increased and the bandwidth is increased.

Figure 6:
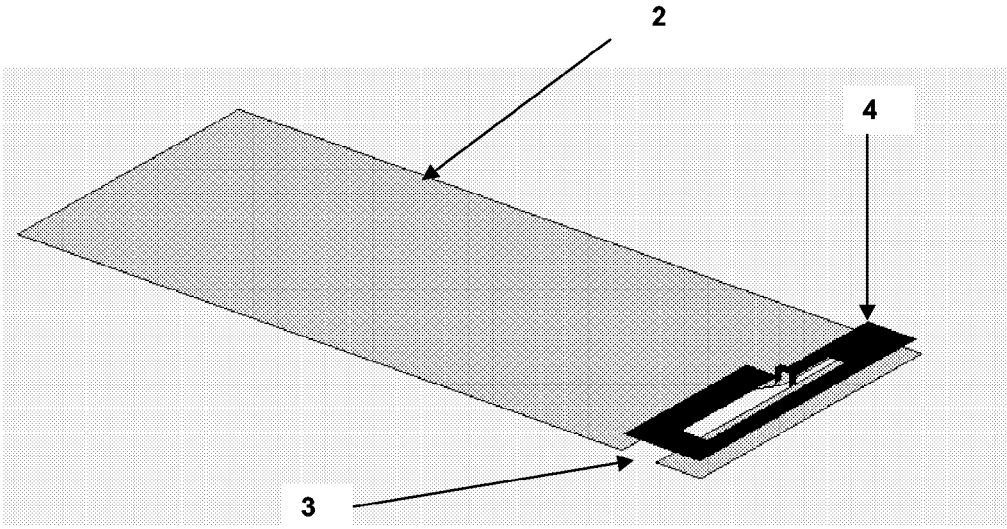

An antenna structure comprising an antenna element 4 and a slotted ground plane 2 according to the present invention may have a slot 3 of variable width. FIG. 6 illustrates an example in which the width of the slot 3 in the ground plane 2 is increased to improve the radiation bandwidth of the wireless device. By widening the slot 3, the frequency response is widened as well. In some other examples (FIG. 9*c*, 10*a* and 10*d*), it may not be practical to widen the entire slot 3 (for instance because the antenna element 4 connections are close or because there is no space left inside the wireless device), in those cases a portion of the slot 3 may be widened, preferably the region away from the connection points of the antenna element 4.

Figure 7:
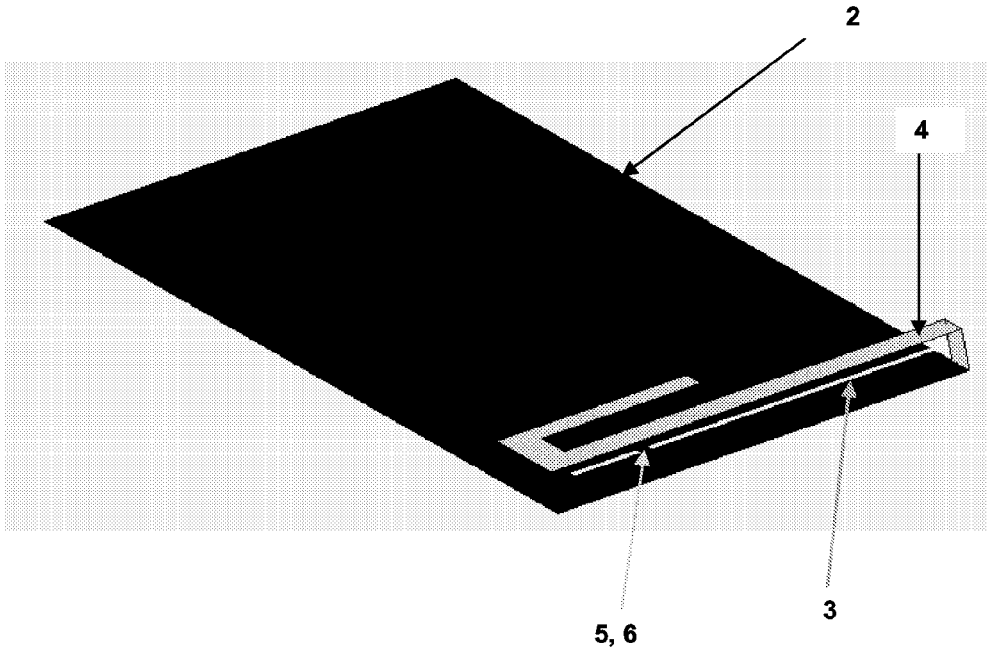
FIG. 7 a schematic view of an antenna structure with a slotted ground plane and a PIFA antenna element.
Figure 8:
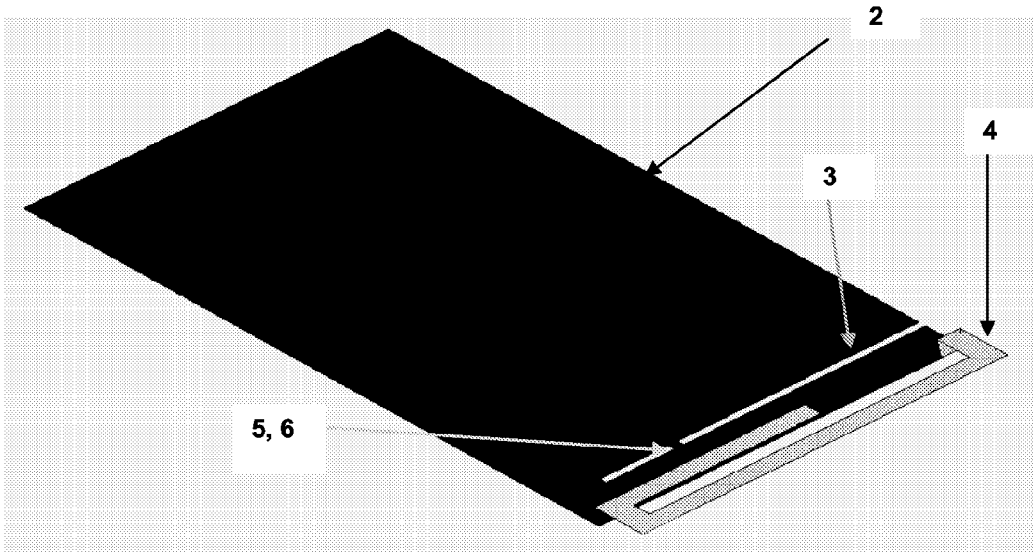
FIG. 8 a schematic view of an antenna structure with a slotted ground plane and an IFA antenna element.
Figure 11A:
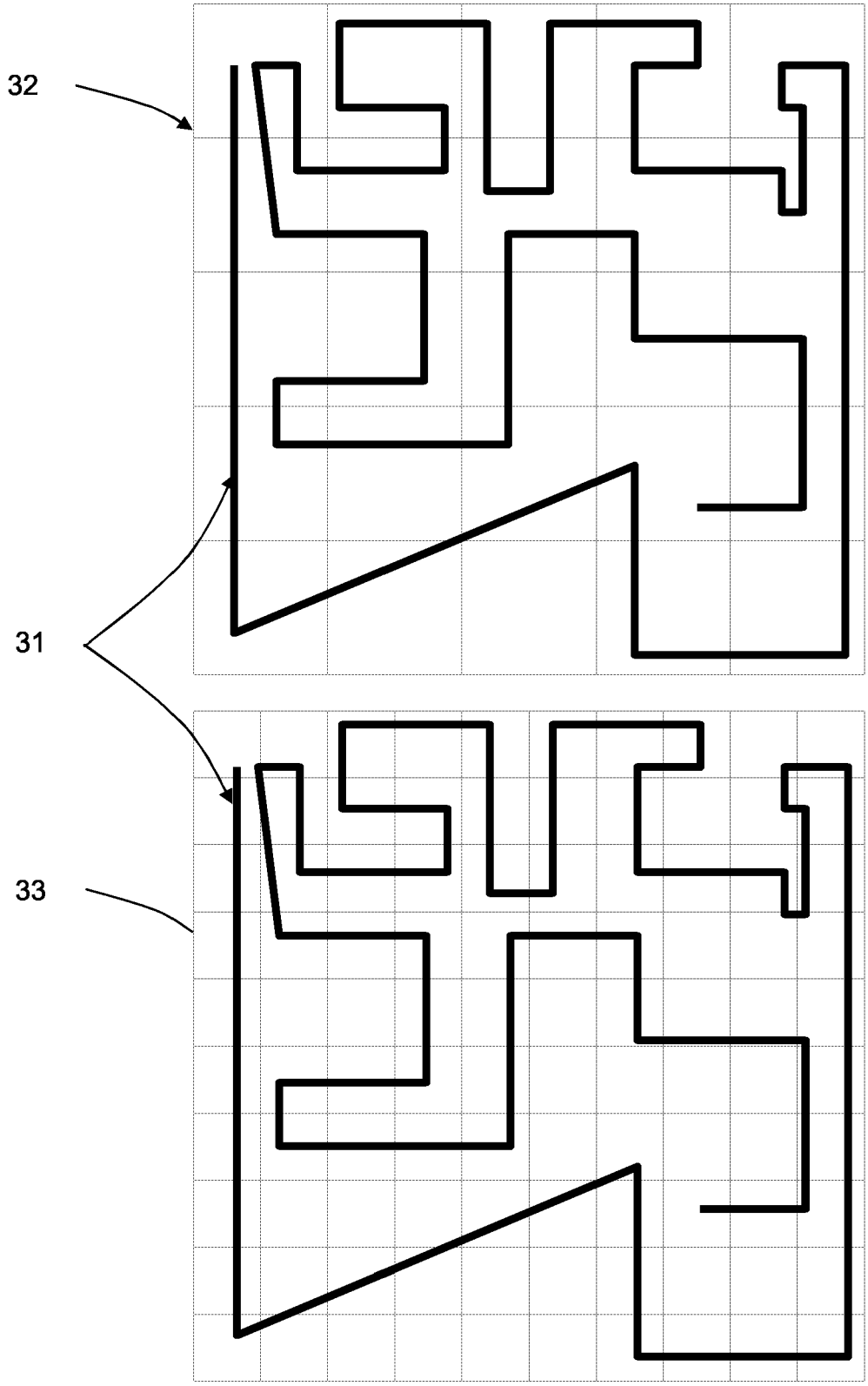
FIG. 11 examples of how to calculate the box counting dimension, and examples 1501 through 1514 of space-filling curves for ground plane design (FIG. 11*b*)
Figure 11B:
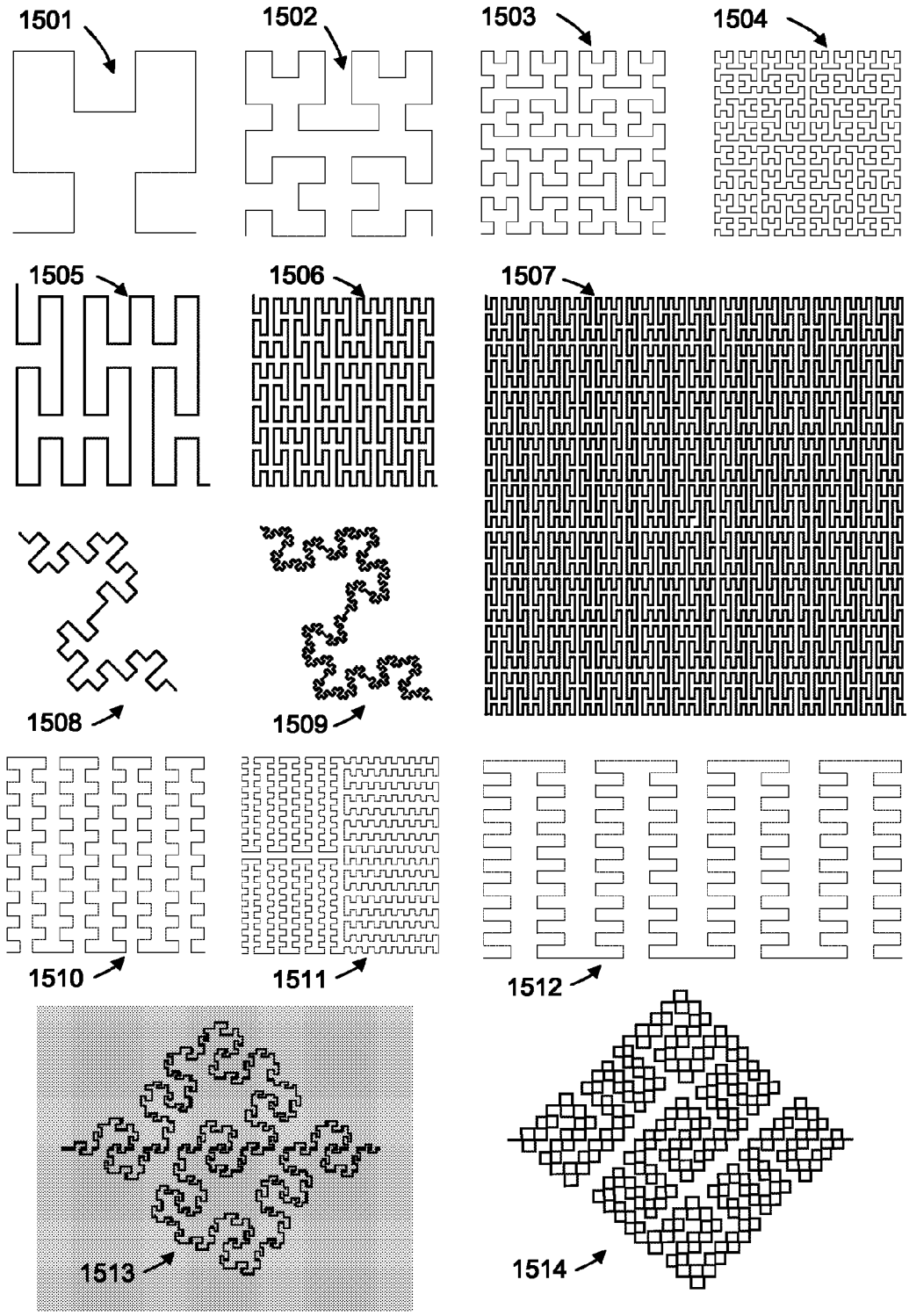
Figures 11C, 11D, 11E:
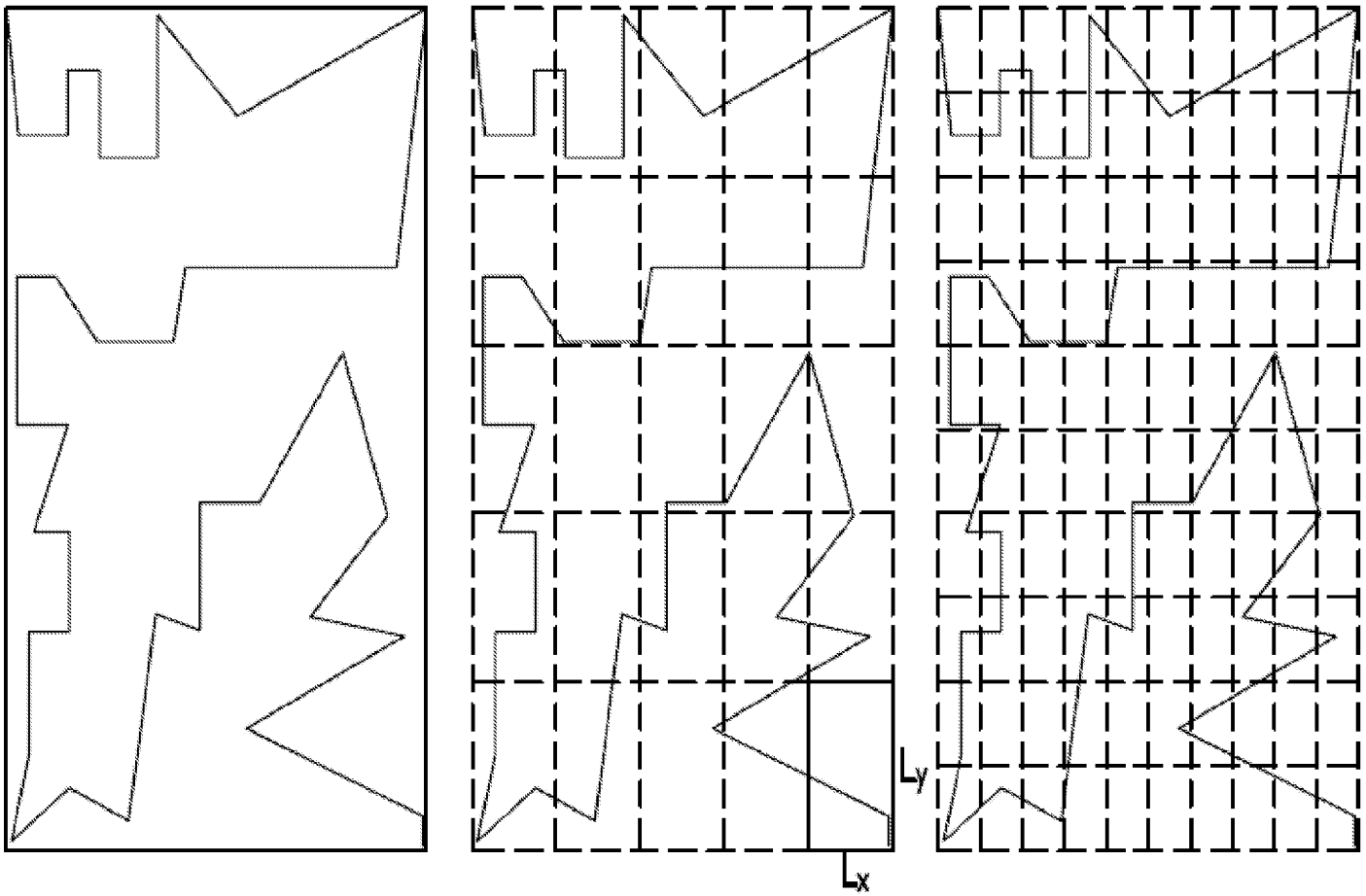
Figure 11F:
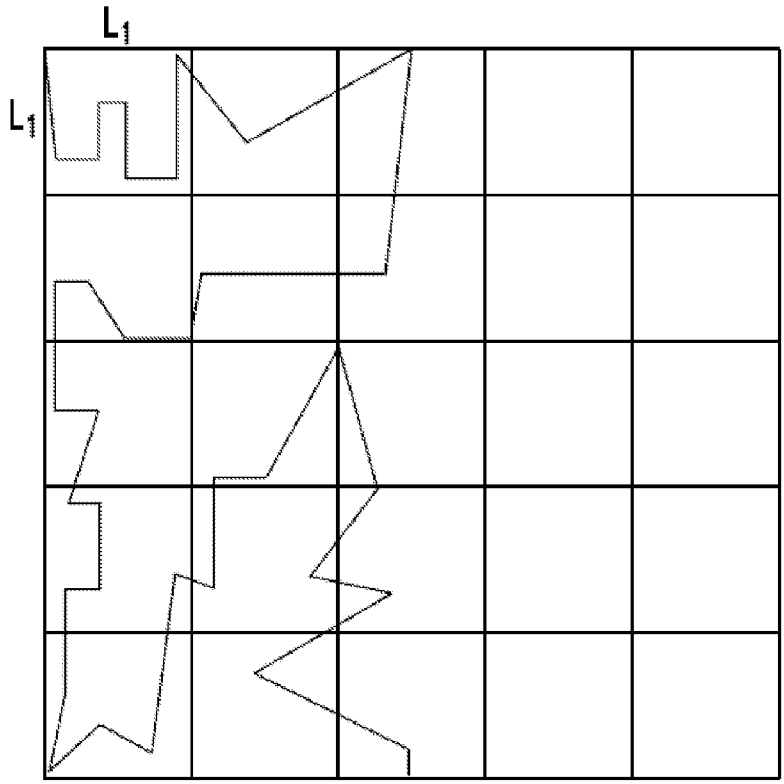
Figure 11G:
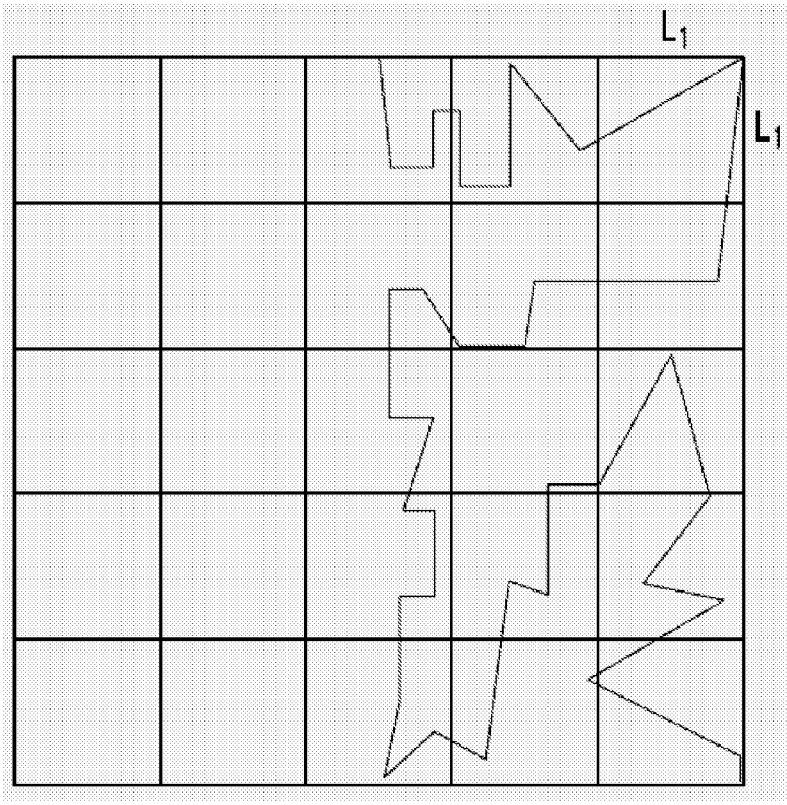
Figure 12:
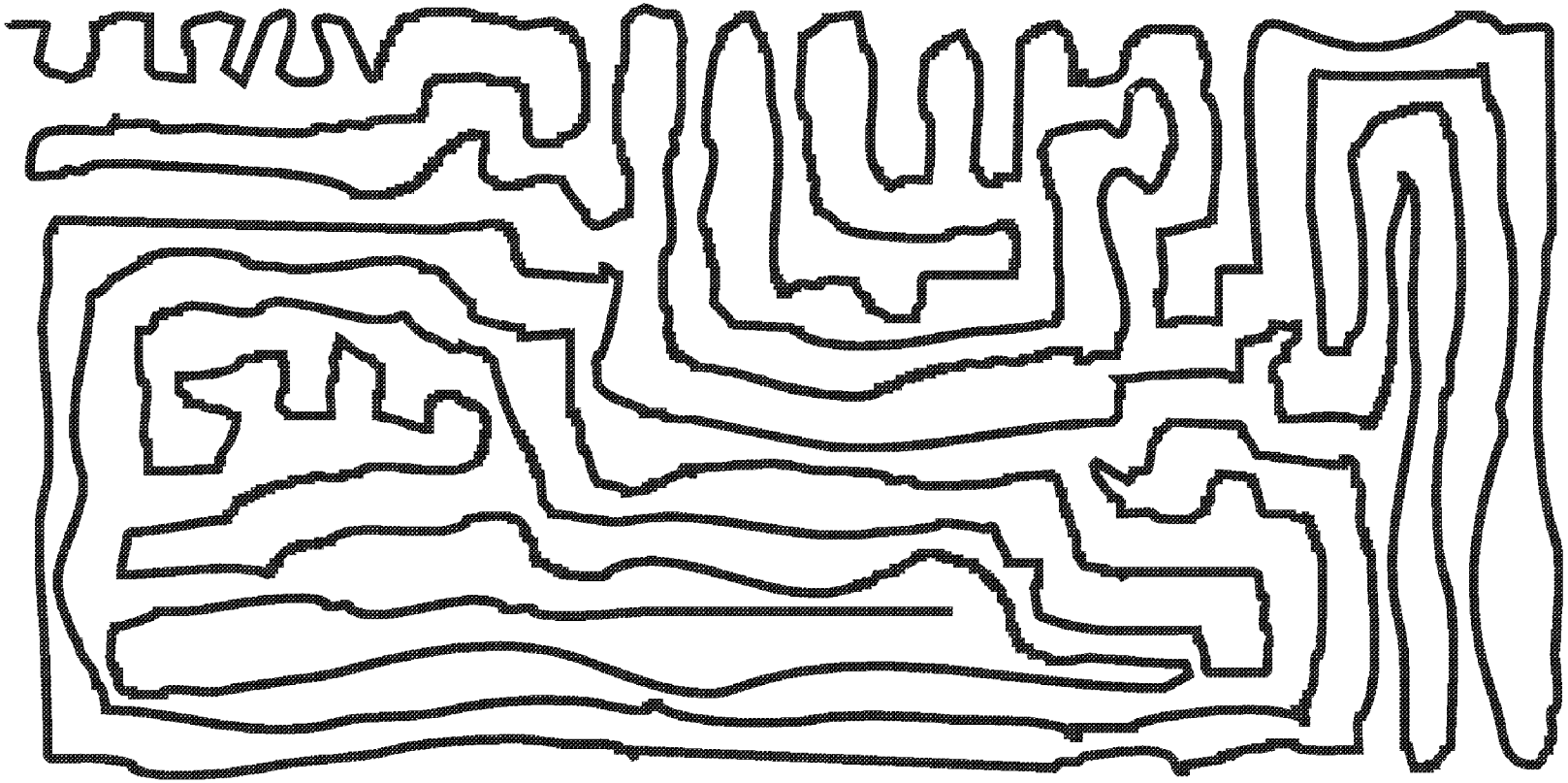
FIG. 12 an example of a curve featuring a grid-dimension larger than 1, referred to herein as a grid-dimension curve.
Figure 13:
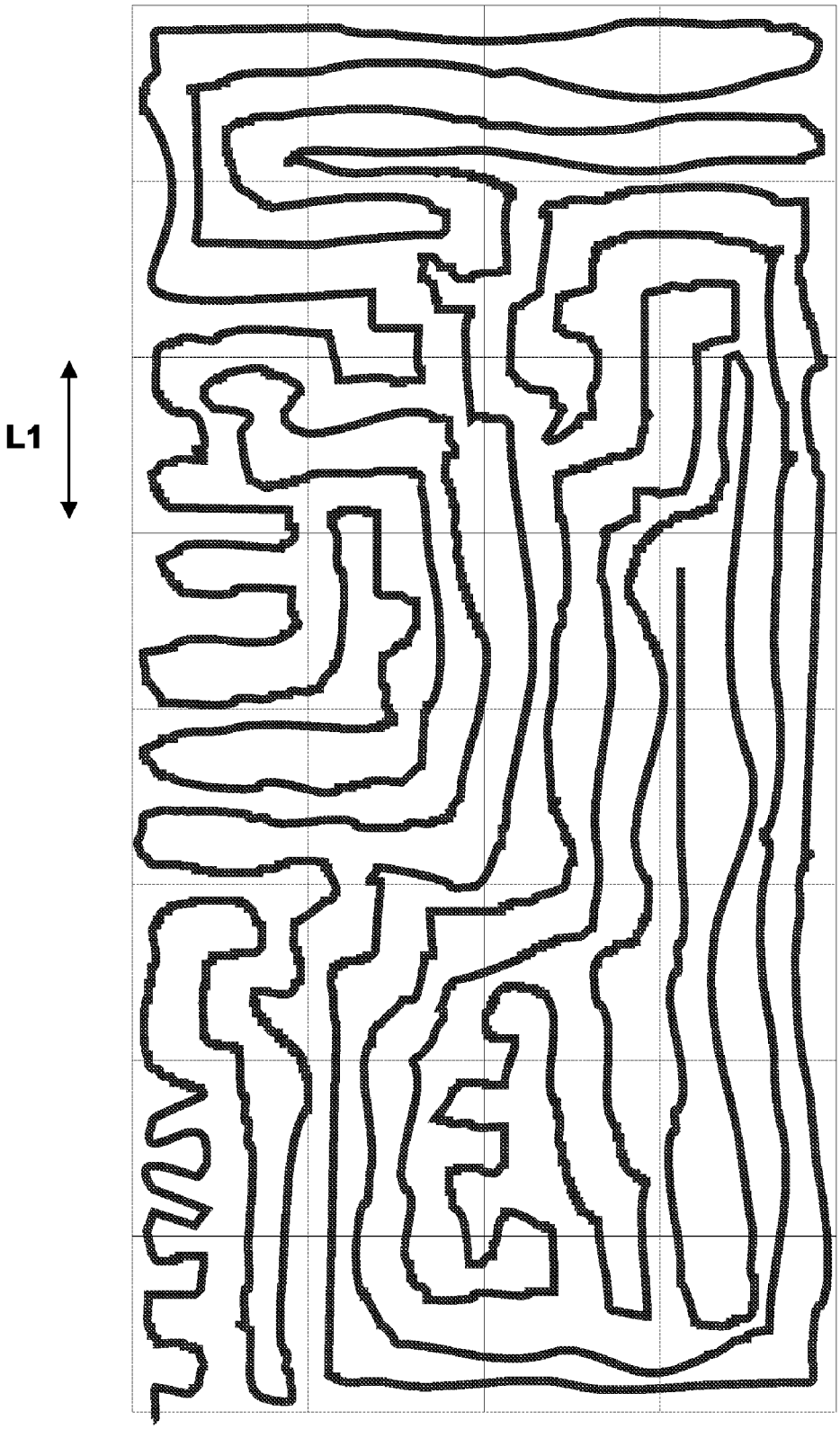
FIG. 13 the curve of FIG. 12 in the 32 cell grid, wherein the curve crosses all 32 cells and therefore N1=32.
Figure 14:
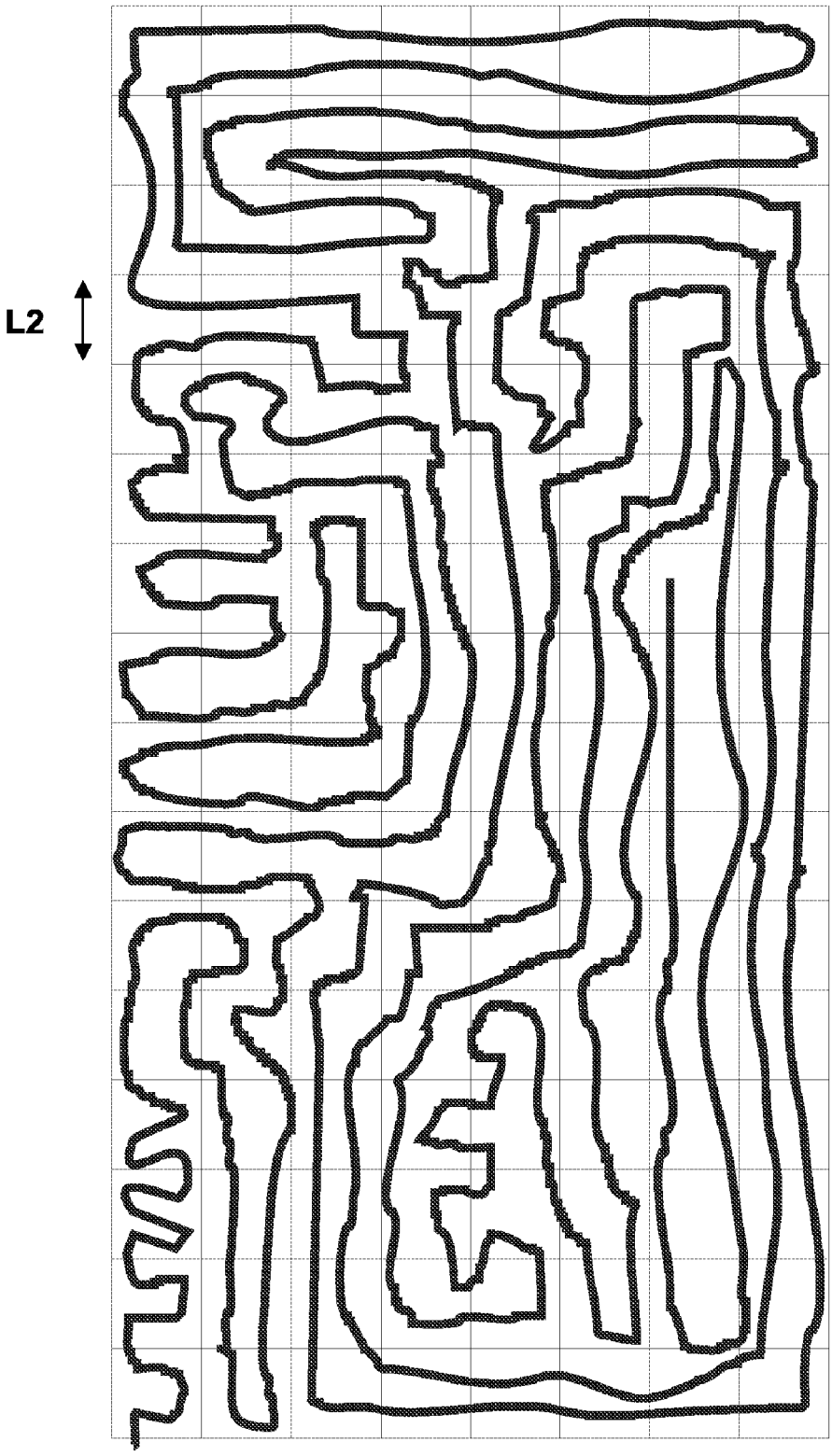
FIG. 14 the curve of FIG. 12 in a 128 cell grid, wherein the curve crosses all 128 cells and therefore N2=128.
Figure 15:
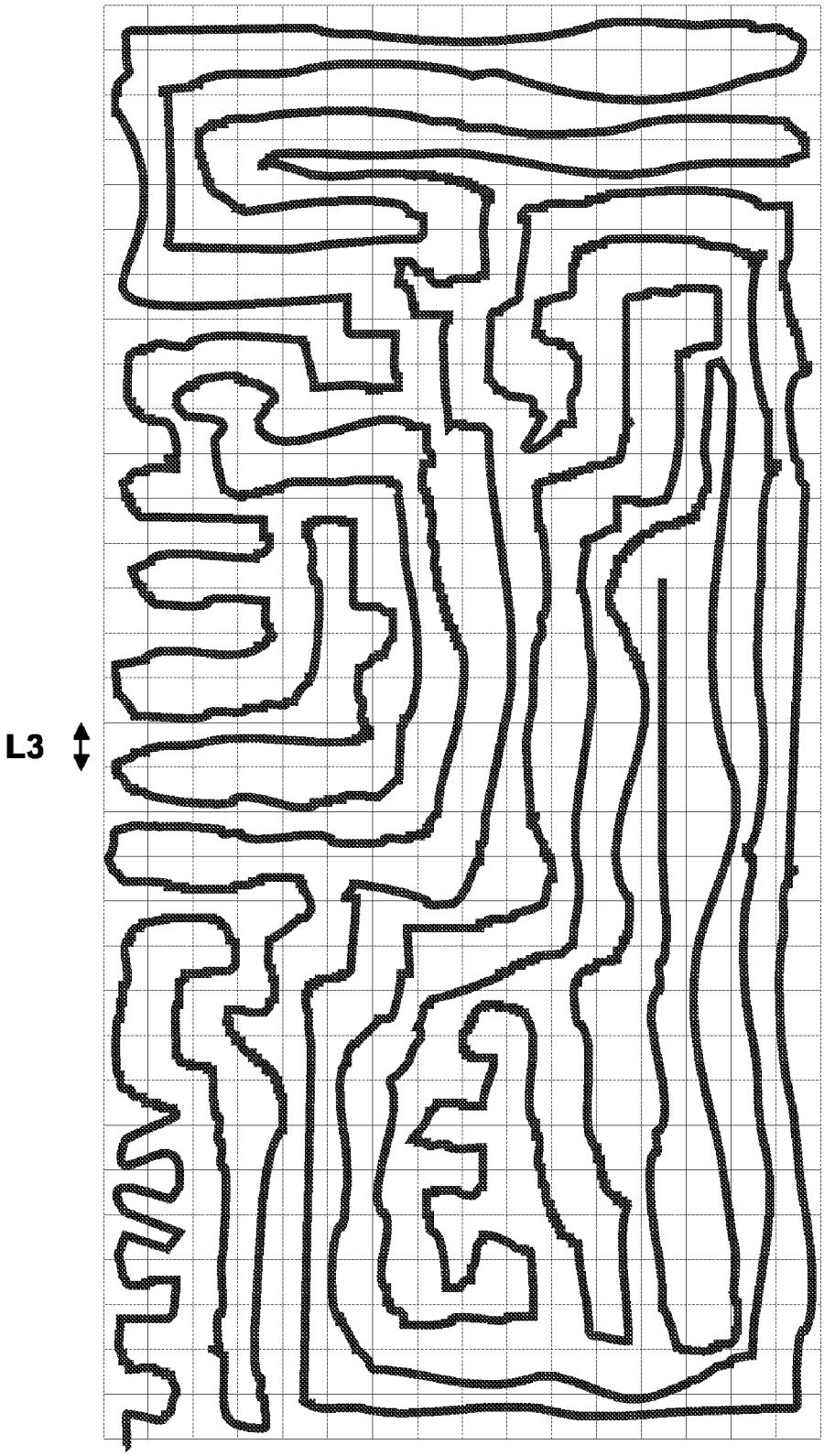
FIG. 15 the curve of FIG. 12 in a 512 cell grid, wherein the curve crosses at least one point of 509 cells.

Other examples are illustrated in FIG. 7 and 8, in which the antenna element 4 has a single connection to ground. The antenna is fed through RF terminals at opposite sides of the slot 3. The electromagnetic fields in the slot 3 are coupled to the antenna element 4, enhancing the radiation process of the whole set. In some examples, such as the example of FIG. 8, the antenna element 4 is an inverted-F antenna and extends outside the footprint of the ground layer. Although this can be used to further enhance the bandwidth if required, it may increase the size of the overall wireless device. A way to compensate for this result is to shorten the ground plane 2 such that the overall dimension of the wireless device is kept constant. In both FIGS. 7 and 8, the slot 3 is excited directly through the feeding 5 and ground 6 connections placed at opposite sides of the slot 3, while the antenna element 4 is coupled through the radiation from the slot 3.

FIGS. 9 and 10 depict schematic views of slotted ground planes 2 according to the invention. In FIG. 9*c*, for instance, a slot 3 of variable width can be seen.

FIGS. 9*d* and 10*c* show ground planes 2 that feature slots 3 that branch out onto two slots 3.

The invention claimed is:

1. A wireless device comprising an antenna structure and a radio frequency (RF) module, the antenna structure comprising:

a ground plane comprising at least one slot;

an antenna element comprising at least one feeding connection to electrically drive the antenna element and at least one ground connection;

wherein the at least one feeding connection is coupled to the RF module;

wherein the at least one slot features a short end in an inner part of the ground plane and a second end;

wherein the at least one feeding connection and the at least one ground connection of the antenna element are placed respectively at two different sides of the at least one slot;

wherein each of the at least one feeding connection and the at least one ground connection are closer to the short end than to the second end; and wherein the at least one feeding connection and the at least one ground connection electrically drive the at least one slot.

2. The wireless device of claim 1, wherein:

the second end is an open end located on a perimeter of said ground plane;

wherein the at least one slot has a length substantially close to a quarter wavelength with respect to at least one operating frequency within said antenna structure; and wherein at least one of the at least one feeding connection and the at least one ground connection is at a distance to the short end of the at least one slot equal to or smaller than an eighth of the wavelength with respect to said at least one operating frequency.

3. The wireless device of claim 1, wherein:

the second end is a second short end located in the inner part of the ground plane;

wherein the at least one slot has a length substantially close to half wavelength with respect to at least one operating frequency within said antenna structure; and wherein at least one of the at least one feeding connection and the at least one ground connection is at a distance to the short end of the at least one slot equal to or smaller than a fourth of the wavelength with respect to said at least one operating frequency.

4. The wireless device of claim 1, wherein the at least one slot features a length d, wherein a distance of at least one of the at least one feeding connection and the at least one ground connection to a short end of the at least one slot is equal to or smaller than a fraction of d, and wherein said fraction is selected from the group consisting of $1/2$, $1/3^{rd}$, $1/4^{th}$, $1/5^{th}$, $1/7^{th}$, $1/8^{th}$, $1/10^{th}$, $1/20^{th}$ and $1/30^{th}$.

5. The wireless device of claim 1, wherein the at least one slot features a length d, wherein a distance of at least one of the at least one feeding connection and the at least one ground connection to the second end of the at least one slot is equal to or larger than a fraction of d, and wherein said fraction is selected from the group consisting of $1/2$, $2/3^{rd}$, $3/4^{th}$, $4/5^{th}$, $6/7^{th}$, $7/8^{th}$, $9/10^{th}$, $19/20^{th}$ and $29/30^{th}$.

6. The wireless device of claim 1, wherein the at least one slot features a length d, wherein a distance of each of the at least one feeding connection and the at least one ground connection to the short end of the at least one slot is equal to or smaller than a fraction of d, and wherein said fraction is selected from the group consisting of $1/2$, $1/3^{rd}$, $1/4^{th}$, $1/5^{th}$, $1/7^{th}$, $1/8^{th}$, $1/10^{th}$, $1/20^{th}$ and $1/30^{th}$.

7. The wireless device of claim 1, wherein the at least one slot features a length d, wherein a distance of each of the at least one feeding connection and the at least one ground connection to the second end of the at least one slot is equal to or larger than a fraction of d, and wherein said fraction is selected from the group consisting of ½, ⅔$^{rd}$, ¾$^{th}$, ⅘$^{th}$, ⅚$^{th}$, ⅞$^{th}$, 9/10$^{th}$, 19/20$^{th}$ and 29/30$^{th}$.

8. The wireless device of claim 1, wherein the at least one feeding connection is placed at a side of the at least one slot that is closer to the RF module of the wireless device.

9. The wireless device of claim 1, wherein said antenna element comprises at least one of a patch antenna, an inverted-F Antenna, a planar inverted-F antenna and a monopole antenna.

10. The wireless device of claim 1, wherein said antenna element comprises an inverted-F antenna, and wherein the at least one feeding connection and the at least one ground connection are provided on the ground plane containing the at least one slot.

11. The wireless device of claim 1, wherein the ground plane is provided on a circuit board.

12. The wireless device of claim 1, wherein the ground plane featuring the at least one slot is provided as a separate ground plane to that of the wireless device.

13. The wireless device of claim 1, wherein the at least one slot is straight.

14. The wireless device of claim 1, wherein the at least one slot is shaped as a geometry chosen from the group consisting of 'L', 'Z', 'S', 'N' and 'M' like shapes.

15. The wireless device of claim 1, wherein the at least one slot is arranged such that the at least one slot surrounds other components on a circuit board of the wireless device.

16. The wireless device of claim 1, wherein at least a portion of the at least one slot is shaped as a geometry chosen from the group consisting of a multilevel structure, a space-filling curve, a grid dimension curve and a contour curve.

17. The wireless device of claim 1, wherein a width of at least a portion of the at least one slot is variable.

18. The wireless device of claim 1, wherein the at least one slot branches out onto two or more slot branches.

19. The wireless device of claim 18, wherein the at least one feeding connection and the at least one ground connection are placed respectively at the two different sides of a portion of a branch.

20. The wireless device of claim 18, wherein a width of at least a portion of a branch is variable.

21. The wireless device of claim 1, wherein said antenna element comprises multiple feeding connections.

22. The wireless device of claim 1, wherein said antenna element comprises multiple ground connections.

23. The wireless device of claim 1, wherein the antenna structure comprises multiple antenna elements.

24. The wireless device of claim 1, wherein the antenna element is substantially flat and is arranged substantially parallel to a portion of the ground plane which is located closest to the antenna element.

25. The wireless device of claim 1, wherein the ground plane and the antenna element are provided on a same side of a circuit board.

26. The wireless device of claim 1, wherein the ground plane and the antenna element are provided on opposite sides of a circuit board.

27. The wireless device of claim 1, wherein the ground plane is provided as a rigid or at least partially rigid conductor.

28. The wireless device of claim 1, wherein the ground plane is provided as a flexible or at least partially flexible conducting material.

29. The wireless device of claim 1, wherein at least a portion of the ground plane is shaped as a geometry chosen from the group consisting of a multilevel structure, a space-filling curve, a grid dimension curve and a contour curve.

30. The wireless device of claim 1, wherein at least a portion of the antenna element is shaped as a geometry chosen from the group consisting of a multilevel structure, a space-filling curve, a grid dimension curve and a contour curve.

31. The wireless device of claim 1, wherein the antenna structure operates in one or more of the following cellular standards and communication systems: Bluetooth, UltraWideBand (UWB), WiFi (IEEE802.11a,b,g), WiMAX (IEEE802.16), PMG, DAB, DBTV, DVB-H, GPS, Galileo, SDARS, GSM900, GSM1800, PCS1900, Korean PCS (KPCS), CDMA, WCDMA, UMTS, 3G, GSM850, ZigBee 868 and ZigBee 915.

32. The wireless device of claim 1, wherein the wireless device is selected from the group of wireless devices consisting of a handheld terminal, a cellular telephone, a cordless telephone, a PDA, an electronic pager, an electronic gaming device, and a remote control.

33. The wireless device of claim 1, wherein the wireless device is a micro-cell base station antenna or a pico-cell base station antenna operating at least one communication system selected from the list consisting of AMPS, GSM900, GSM1800, UMTS, PCS1900, DCS, DECT, and WLAN.

34. The wireless device of claim 1, wherein the wireless device is a mobile phone.

35. The wireless device of claim 34, wherein the mobile phone features a maximum width equal to or smaller than w, and wherein w is selected from the group consisting of 14, 12, 11, 10, 9, 8 and 7 mm.

36. The wireless device of claim 34, wherein the mobile phone features a form-factor selected from the group of form-factors consisting of slider, clamshell, flip and bar.

37. A method to integrate an antenna structure in a wireless device, the method comprising:

providing a ground plane to said wireless device;

providing said ground plane with a slot featuring a short end in an inner part of the ground plane and a second end;

designing and providing an antenna element to said wireless device, the antenna element comprising at least one feeding connection to electrically drive the antenna element and at least one ground connection;

tuning said slot by placing the at least one feeding connection and the at least one ground connection respectively at two different sides of said slot;

wherein each of the at least one feeding connection and the at least one ground connection are closer to the short end than to the second end; and electrically driving the slot with the at least one feeding connection and the at least one ground connection.

38. The method of claim 37, wherein:

the second end is an open end located on a perimeter of said ground plane;

wherein said slot has a length substantially close to a quarter wavelength with respect to at least one operating frequency within said antenna structure; and wherein at least one of the at least one feeding connection and the at least one ground connection is at a distance to the short end of said slot equal to or smaller than an eighth of the wavelength with respect to said at least one operating frequency.

39. The method of claim 37, wherein:

the second end is a second short end located in the inner part of the ground plane;

wherein said slot has a length substantially close to half wavelength with respect to at least one operating frequency within said antenna structure; and wherein at least one of the at least one feeding connection and the at least one ground connection is at a distance to the short end of said slot equal to or smaller than a quarter of the wavelength with respect to said at least one operating frequency.

40. The method of claim 37, wherein said slot is provided in a ground layer of a circuit board.

41. The method of claim 37, wherein said slot is of variable width.

* * * * *